US010563480B2

(12) United States Patent
Campbell et al.

(10) Patent No.: US 10,563,480 B2
(45) Date of Patent: Feb. 18, 2020

(54) PROFILE SELECTIVE SYSTEM FOR DOWNHOLE TOOLS

(71) Applicant: Gryphon Oilfield Solutions, LLC, Houston, TX (US)

(72) Inventors: Sean Patrick Campbell, DeWinton (CA); Darryl Firmaniuk, Albert (CA); Lennard Sihlis, Albert (CA)

( * ) Notice: Subject to any disclaimer, the term of this patent is extended or adjusted under 35 U.S.C. 154(b) by 195 days.

(21) Appl. No.: 15/681,038

(22) Filed: Aug. 18, 2017

(65) Prior Publication Data

US 2017/0350215 A1 Dec. 7, 2017

Related U.S. Application Data

(63) Continuation of application No. 14/454,508, filed on Aug. 7, 2014, now Pat. No. 9,739,117, which is a continuation-in-part of application No. 13/643,977, filed as application No. PCT/CA2011/000495 on Apr. 28, 2011, now Pat. No. 9,611,727.

(60) Provisional application No. 61/376,364, filed on Aug. 24, 2010, provisional application No. 61/328,770, filed on Apr. 28, 2010.

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC .... E21B 43/26; E21B 34/14; E21B 2034/007; E21B 34/16; E21B 31/00; E21B 43/267; E21B 33/12; E21B 34/06
See application file for complete search history.

(56) References Cited

U.S. PATENT DOCUMENTS

| | | | |
|---|---|---|---|
| 2,797,821 | A | 7/1957 | Blattner |
| 3,247,905 | A | 4/1966 | Baker |
| 4,043,392 | A | 8/1977 | Gazda |
| 4,436,152 | A | 3/1984 | Fisher, Jr. et al. |
| 5,775,433 | A | 7/1998 | Hammett et al. |
| 6,006,838 | A | 12/1999 | Whiteley et al. |
| 7,325,617 | B2 | 2/2008 | Murray |
| 7,334,650 | B2 | 2/2008 | Giroux et al. |

(Continued)

FOREIGN PATENT DOCUMENTS

| | | | |
|---|---|---|---|
| CA | 2797821 | A1 | 11/2011 |
| WO | 2010059060 | | 5/2010 |
| WO | 2011134069 | A1 | 11/2011 |

OTHER PUBLICATIONS

IPR 2018-00776 relating to U.S. Pat. No. 9,611,727.

(Continued)

*Primary Examiner* — Wei Wang

(57) ABSTRACT

A method and apparatus for selectively actuating a downhole tool in a tubular conduit. An actuator tool has an actuator mandrel having an actuator bore through and a profile key to selectively engage the downhole tool. The downhole tool has one or more profile receivers adapted to actuate the downhole tool. The actuator tool is conveyed into the tubular conduit and the actuator tool and the downhole tool are engaged if the profile key and the profile receiver match, and the actuator tool and the downhole tool are non-engaged if the profile key and the profile receiver do not match. Fluid may be circulated through the actuator bore to flush or wash ahead of the actuator tool.

22 Claims, 18 Drawing Sheets

(56) References Cited

U.S. PATENT DOCUMENTS

| | | | |
|---|---|---|---|
| 7,387,165 | B2 | 6/2008 | Lopez de Cardenas et al. |
| 7,552,779 | B2 | 6/2009 | Murray |
| 7,926,580 | B1 | 4/2011 | Darnell et al. |
| 8,215,411 | B2 | 7/2012 | Flores et al. |
| 8,496,051 | B2 | 7/2013 | Cejero et al. |
| 2003/0173089 | A1 | 9/2003 | Westgard et al. |
| 2006/0124310 | A1 | 6/2006 | Lopez de Cardenas et al. |
| 2008/0302538 | A1 | 12/2008 | Hofman |
| 2009/0266659 | A1 | 10/2009 | Lembcke et al. |
| 2011/0240311 | A1 | 10/2011 | Robison et al. |

OTHER PUBLICATIONS

Preliminary Invalidity Contentions from case No. H-17/3220, S. Dist. or TX.

Site oil tools, inc., 1988 catalog, pp. 83, 86, 90.

Otis Engineering Corporation, Regular Merchandise Commodity Bulletin No. 2, Jul. 1, 1971, pp. 1-66, USA.

IPR2018-00776, U.S. Pat. No. 9,611,727, PTAB, *Stage Completions Inc. and Stage Completions* (*USA*) *Corp*. v. *Gryphon Oilfield Solutions, LLC*.

International Search Report and Written Opinion dated Aug. 8, 2011, from International App. No. PCT/CA2011/000495 with International Filing Date of Apr. 28, 2011, (9 pages).

Office Action dated Dec. 20, 2013, received on Canadian Pat. App. No. 2,797,821 (3 pages).

PROFILE SELECTIVE SYSTEM FOR DOWNHOLE TOOLS

CROSS REFERENCE TO RELATED APPLICATIONS

This application is a continuation of U.S. patent application Ser. No. 14/454,508, filed Aug. 7, 2014, issued as U.S. Pat. No. 9,739,117 on Aug. 22, 2017 which is a continuation-in-part of U.S. patent application Ser. No. 13/643,977, filed Mar. 22, 2013, issued as U.S. Pat. No. 9,611,727 on Apr. 4, 2017, which is a national phase entry of International Patent Application No. PCT/CA2011/00495 filed on Apr. 28, 2011, which claims the benefit of U.S. Provisional Patent Application No. 61/328,770, filed on Apr. 28, 2010 and U.S. Provisional Patent Application No. 61/376,364, filed Aug. 24, 2010, all of which are incorporated herein by reference in their entirety.

FIELD

The present disclosure relates generally to downhole tools for oil and gas wells. More particularly, the present disclosure relates to a method and system for selectively activating or engaging a downhole tool, such as one or more port tools.

BACKGROUND

In some downhole oil and gas operations, it is known to actuate one or more downhole tools using a drop ball introduced into the well from surface.

Drop ball systems may utilize a number of drop balls of different sizes or ball seats of different sizes to allow selective activation of a downhole tool, such as a port tool, from surface. The lateral or horizontal fracturing (frac) systems used with such ball systems at present are generally restricted to high pressure and low flow rate due to practical limitations in the design and configuration of the ball seat opening.

WO 2011/134069 describes an apparatus and method for fracturing a well including a groove and key configuration.

It is, therefore, desirable to provide a system and method for selectively activating or engaging a downhole tool.

SUMMARY

The profile selective system includes one or more profile receivers associated with one or more downhole tools, and one or more actuator tools having a profile key. In an embodiment disclosed, the actuator tool may comprise a dart.

Each profile receiver should have a corresponding profile key. The profile key will pass through a non-matching profile receiver and only engage or lock into a matching profile receiver. The profile key may be numbered or otherwise identified to indicate the unique matching receiver.

The one or more downhole tools can be used with open hole packers, cemented in the wellbore with the well casing, or otherwise positioned in the well.

The profile selective system may be applied to many different tool applications including, but not limited to, a selective port tool, a selective debris tool, a selective packer tool, or a selective wiper tool.

In the case of a port tool, the port tool may include a profile receiver, and a profile selective tool having a non-matching profile key will pass by the non-matching profile receiver without engaging, but if the profile selective tool has a matching profile key, the profile selective tool will engage the matching profile receiver and will activate the port tool, for example by opening a valve port. The frac or pumping operation may be conducted with less restriction because the valve port provides a less restricted opening compared to, for example, a ball seat opening. The less restricted opening may also provide benefits when the well is producing, after the frac is completed.

In an embodiment disclosed the profile selective system is automatic in that once the user selects a port tool and a profile selective tool having a corresponding key and conveys the profile selective tool into the well, the predetermined port tool is actuated.

In a first aspect, disclosed is a method of engaging a downhole tool in a tubular conduit including providing an actuator tool having an actuator mandrel having an actuator bore through and a bypass, and a profile key to selectively engage the downhole tool, providing the downhole tool, comprising one or more profile receivers adapted to actuate the downhole tool, conveying the actuator tool into at least one of the one or more profile receivers, wherein the actuator tool and the downhole tool are engaged if the profile key and the profile receiver match, and the actuator tool and the downhole tool are non-engaged if the profile key and the profile receiver do not match.

In an embodiment disclosed, the tubular conduit is well tubing or well casing.

In an embodiment disclosed, the profile key matches one of the one or more profile receivers.

In an embodiment disclosed, the profile key matches more than one of the one or more profile receivers.

In an embodiment disclosed, the method further includes providing a retrieval tool, conveying the retrieval tool into the tubular conduit to connect with and release the actuator tool, opening the bypass, and circulating fluid through the retrieval tool and the actuator bore of the actuator tool.

In a further aspect, disclosed is a method of fracturing a subterranean formation penetrated by a wellbore, including providing one or more port tools, attached to a tubular conduit within the wellbore, each of the one or more port tools having a frac port, a valve sleeve adapted to shift between a port closed position and a port open position, and a profile receiver associated with the valve sleeve, providing an actuator tool having an actuator mandrel having an actuator bore through and a bypass, and a profile key to selectively engage the profile receiver, conveying the actuator tool into at least one of the one or more port tools, the actuator tool and the at least one profile receiver engaged if the profile key and the profile receiver match, and the actuator tool and the at least one receiver non-engaged if the profile key and the profile receiver do not match, wherein the profile receiver is adapted to shift the valve sleeve into the port open position to open the frac port, when the profile receiver is engaged, and conveying a fracturing fluid down the tubular conduit, and through the frac port into the formation, and propagating fractures in the formation.

In an embodiment disclosed, the method further includes shifting the valve sleeve of at least one of the one or more port tools into the port closed position.

In an embodiment disclosed, the one or more port tools are cemented in the wellbore with the tubular conduit.

In an embodiment disclosed, the one or more port tools are positioned in the wellbore with open hole packers.

In a further aspect, disclosed is a method of multi-stage fracturing a subterranean formation penetrated by a wellbore, including providing a first port tool, attached to a tubular conduit within the wellbore, having a first frac port, a first valve sleeve adapted to shift between a port closed position and a port open position, and a first profile receiver associated with the first valve sleeve, providing a second port tool spaced apart relative to the first port tool, attached to the tubular conduit within the wellbore, having a second frac port, a second valve sleeve adapted to shift between a port closed position and a port open position, and a second profile receiver associated with the second valve sleeve, the second port tool uphole from the first port tool, isolating the wellbore between the second port tool and the first port tool, providing a first actuator tool having an actuator mandrel having an actuator bore through and a bypass, and a first profile key, the first profile key matching the first profile receiver, conveying the first actuator tool into the tubular conduit, past the second profile receiver, the first profile key and the second profile receiver non-engaged, further conveying the first actuator tool into the tubular conduit, into the first profile receiver, the first profile key and the first profile receiver engaged, wherein the first valve sleeve is shifted into the port open position to open the first frac port, and conveying a fracturing fluid down the tubular conduit, and through the first frac port to frac the formation.

In an embodiment disclosed, the method further includes providing a second actuator tool having an actuator mandrel having an actuator bore through and a bypass, and a second profile key, the second profile key matching the second profile receiver, conveying the second actuator tool into the tubular conduit, into the second profile receiver, the second profile key and the second profile receiver engaged, wherein the second valve sleeve is shifted into the port open position to open the second frac port, and conveying a fracturing fluid down the tubular conduit, and through the second frac port to frac the formation.

In an embodiment disclosed, the method further includes sealing the tubular conduit between the first port tool and the second port tool, prior to conveying the second actuator tool into the tubular conduit.

In an embodiment disclosed, the method further includes providing a retrieval tool on a tubing string, conveying the retrieval tool into the tubular conduit to connect with and release the second actuator tool, further conveying the retrieval tool and the second actuator tool into the tubular conduit to connect with and release the first actuator tool, and retrieving the retrieval tool, the second actuator tool, and the first actuator tool from the tubular conduit in a single trip.

In an embodiment disclosed, the method further includes activating the bypass of the second actuator tool by engagement with the retrieval tool and conveying fluid down the tubing string through the retrieval tool and through the actuator bore of the second actuator tool into the tubular conduit to wash above the first actuator tool prior to connecting with the first actuator tool.

In an embodiment disclosed, the first actuator tool includes a first cup for conveying the first actuator tool, the method further comprising activating a first cup bypass to bypass the first cup prior to retrieving the first actuator tool in order to reduce swabbing.

In an embodiment disclosed, the second actuator tool includes a second cup for conveying the second actuator tool, the method further comprising activating a second cup bypass to bypass the second cup prior to retrieving the second actuator tool in order to reduce swabbing.

In a further aspect, disclosed is a method of multi-stage fracturing a subterranean formation penetrated by a wellbore, including providing a first port tool, attached to a tubular conduit within the wellbore, having a first frac port, a first valve sleeve adapted to shift between a port closed position and a port open position, and a first profile receiver associated with the first valve sleeve, providing a second port tool spaced apart relative to the first port tool, attached to the tubular conduit within the wellbore, having a second frac port, a second valve sleeve adapted to shift between a port closed position and a port open position, and a second profile receiver associated with the second valve sleeve, the second port tool uphole from the first port tool, providing a third port tool spaced apart relative to the second port tool, attached to the tubular conduit within the wellbore, having a third frac port, a third valve sleeve adapted to shift between a port closed position and a port open position, and a third profile receiver associated with the third valve sleeve, the third port tool uphole from the second port tool, providing a fourth port tool spaced apart relative to the third port tool, attached to the tubular conduit within the wellbore, having a fourth frac port, a fourth valve sleeve adapted to shift between a port closed position and a port open position, and a fourth profile receiver associated with the fourth valve sleeve, the fourth port tool uphole from the third port tool, isolating the wellbore between the second port tool and the first port tool, isolating the wellbore between the third port tool and the second port tool, isolating the wellbore between the fourth port tool and the third port tool, providing a first cluster actuator tool comprising an actuator mandrel having an actuator bore through and a bypass; and a first cluster profile key, the first cluster profile key matching the second profile receiver and the first profile receiver, conveying the first cluster actuator tool into the tubular conduit, past the fourth profile receiver, the fourth profile key and the fourth profile receiver non-engaged, further conveying the first cluster actuator tool into the tubular conduit, past the third profile receiver, the third profile key and the third profile receiver non-engaged, further conveying the first cluster actuator tool into the tubular conduit, into the second profile receiver, the first cluster profile key and the second profile receiver engaged, wherein the second valve sleeve is shifted into the port open position to open the second frac port, further conveying the first cluster actuator tool into the tubular conduit, into the first profile receiver, the first cluster profile key and the first profile receiver engaged, wherein the first valve sleeve is shifted into the port open position to open the first frac port, and conveying a fracturing fluid down the tubular conduit, and through the second frac port and the first frac port to frac the formation.

In an embodiment disclosed, the method further includes providing a second cluster actuator tool comprising an actuator mandrel having an actuator bore through and a bypass; and a second cluster profile key, the second cluster profile key matching the fourth profile receiver and the third profile receiver, conveying the second cluster actuator tool into the tubular conduit, into the fourth profile receiver, the second cluster profile key and the fourth profile receiver engaged, wherein the fourth valve sleeve is shifted into the port open position to open the fourth frac port, further conveying the second cluster actuator tool into the tubular conduit, into the third profile receiver, the second cluster profile key and the third profile receiver engaged, wherein the third valve sleeve is shifted into the port open position to open the third frac port, and conveying a fracturing fluid down the tubular conduit, and through the fourth frac port and the third frac port to frac the formation.

In an embodiment disclosed, the method further includes providing a retrieval tool, conveying the retrieval tool into the tubular conduit to connect with and release the second actuator tool, further conveying the retrieval tool and the second actuator tool into the tubular conduit to connect with and release the first actuator tool, and retrieving the retrieval tool, the second actuator tool, and the first actuator tool from the tubular conduit in a single trip.

In an embodiment disclosed, the method further includes activating the bypass of the second actuator tool and conveying fluid down the retrieval tool and through the actuator bore of the second actuator tool into the tubular conduit to wash above the first actuator tool prior to connecting with the first actuator tool.

In an embodiment disclosed, wherein the first actuator tool includes a first cup for conveying the first actuator tool, the method further includes activating a first cup bypass to bypass the first cup prior to retrieving the first actuator tool in order to reduce swabbing. In an embodiment disclosed, wherein the second actuator tool includes a second cup for conveying the second actuator tool, the method further includes activating a second cup bypass to bypass the second cup prior to retrieving the second actuator tool in order to reduce swabbing.

In an embodiment disclosed, one or more open hole packers are used to isolate the wellbore between the port tools.

In an embodiment disclosed, cement is used to isolate the wellbore between the port tools.

In a further aspect, disclosed is a method of fracturing a subterranean formation penetrated by a wellbore, including providing a plurality of spaced apart port tools, attached to a tubular conduit within the wellbore, each having a frac port, a valve sleeve adapted to shift between a port closed position and a port open position, and a profile receiver associated with the valve sleeve, adapted to be actuated with an actuator tool having a corresponding profile key and an actuator bore through and a bypass, selecting at least one of the plurality of port tools to provide a re-entry port tool to remain non-actuated for future operation, selectively activating the plurality of port tools other than the re-entry port tool by providing actuator tools having the corresponding profile keys, and conveying a fracturing fluid down the tubular conduit, and through the plurality of port tools other than the re-entry port tool to frac the formation.

In an embodiment disclosed, the plurality of port tools other than the re-entry port tool are actuated and the formation is fractured sequentially, in stages.

In a further aspect, disclosed is a profile selective system for actuating a downhole tool in a tubular conduit including an actuator tool comprising a profile key adapted to selectively engage the downhole tool, the actuator tool comprising an actuator mandrel having an actuator bore through and a bypass, the downhole tool having a profile receiver adapted to actuate the downhole tool, a conveyor for conveying the actuator tool through the tubular conduit, the profile key and the profile receiver adapted to engage if the profile key and the profile receiver match, and the profile key and the profile receiver adapted to non-engage if the profile key and the profile receiver do not match.

In an embodiment disclosed, the bypass includes a bypass port selectively sealed by a bypass valve sleeve.

In an embodiment disclosed, the actuator tool further includes a flow back bypass sealing the actuator bore. In an embodiment disclosed, the flow back bypass includes a poppet valve biased toward a poppet valve seat by a spring to seal the actuator bore. In an embodiment disclosed, the poppet valve is adapted to unseal the actuator bore in response to fluid pressure in the actuator bore applied to the poppet valve to overcome the spring.

In an embodiment disclosed, the profile key includes a plurality of outer surface sections of a tool mandrel.

In an embodiment disclosed, the profile receiver includes an inner circumferential surface of a tubular mandrel.

In an embodiment disclosed, the profile key is biased radially outwards toward the inner diameter of the tubular conduit.

In an embodiment disclosed, the conveyor includes a cup tool. In an embodiment disclosed, the actuator tool includes a conveyor bypass. In an embodiment disclosed, the conveyor bypass includes a cup bypass. In an embodiment disclosed, the cup bypass includes a passage releasably sealed between an upper actuator mandrel and an actuator mandrel. In an embodiment disclosed, the cup bypass is opened by pulling the upper actuator mandrel relative to the actuator mandrel. In an embodiment disclosed, the cup bypass is opened as the actuator tool is released.

In an embodiment disclosed, the downhole tool is selected from the group consisting of a selective fracturing port tool, a selective debris tool, a selective packer tool, and a selective wiper tool.

In an embodiment disclosed, the tubular conduit is well tubing or well casing.

In an embodiment disclosed, the profile selective system further includes a retrieval tool adapted to provide a fluid to the actuator tool for circulation through the actuator bore to allow circulation of the fluid ahead of the actuator tool.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures, wherein.

DETAILED DESCRIPTION

Generally, the present disclosure provides a method and system for selectively engaging or activating a downhole tool.

Profile Key and Profile Receiver

Figure 1:
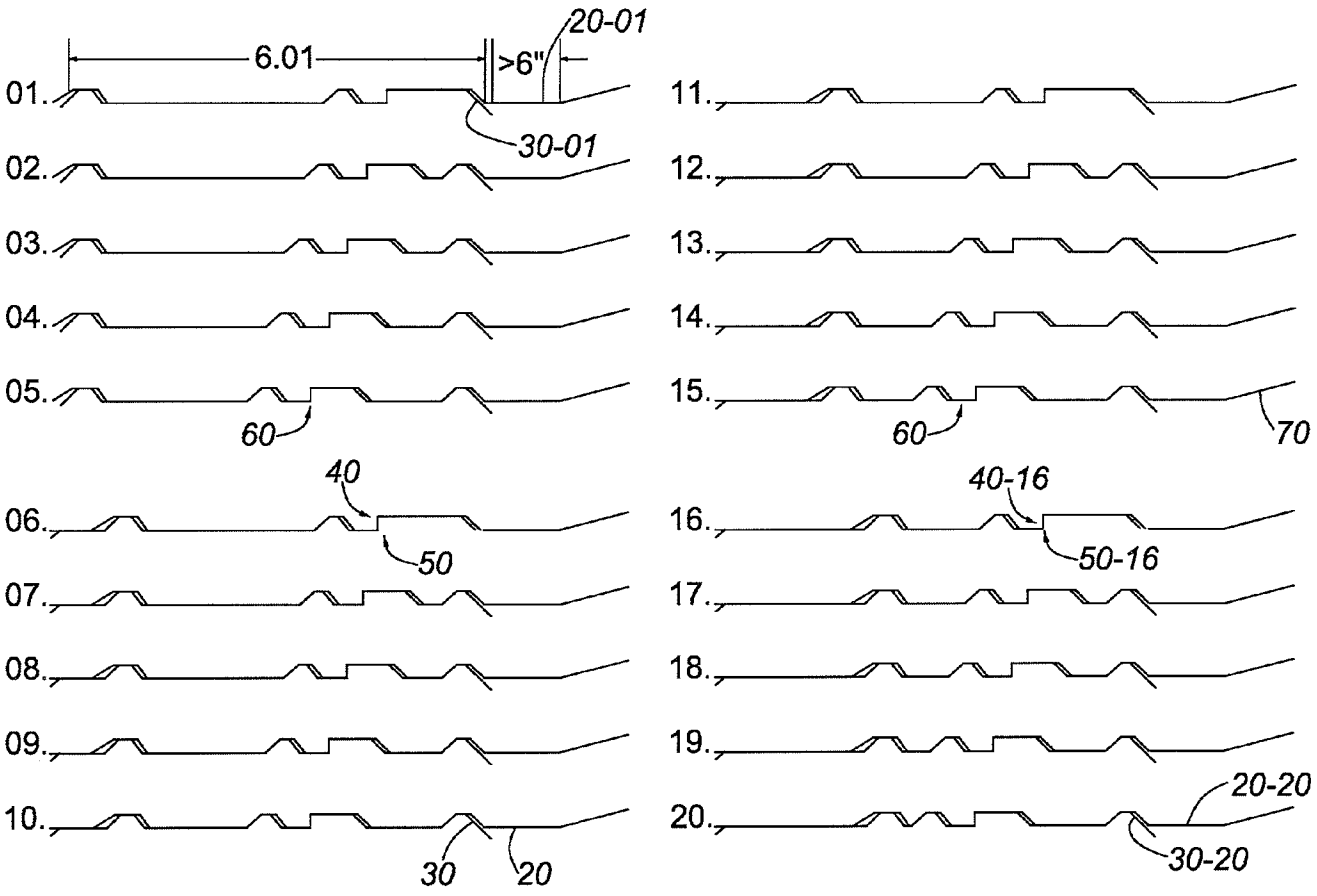
FIG. 1 is a simplified representation of several profile keys and profile receivers of the present disclosure.

Referring to FIG. 1, several matching sets of a profile key 20 and a profile receiver 30 are shown. Twenty (20) sets are shown, for example only, numbered 20-01/30-01 through 20-20/30-20. The number of sets that may be used is not limited to twenty (20) sets. In an embodiment disclosed, each profile key 20 matches one profile receiver 30 (as shown).

As depicted, for example the profile key 20-01 engages the profile receiver 30-01 because the key 20 and the receiver 30 match. However profile key 20-01 would not engage any of the profile receivers 30-02 through 30-20 because the profile key 20 and the profile receiver 30 do not match, and the profile key 20-01 would instead pass over any of the profile receivers 30-20 through 30-02.

A profile key notch 40 and a corresponding profile receiver notch 50 provide for a positive lateral connection between a corresponding profile key 20 and profile receiver 30, such as between 20-06/30-06, 20-16/30-16 etc. The abutment of the profile key notch 40 and the profile receiver notch 50 provide a bearing surface 60 to transmit forces between the profile key 20 and the profile receiver 30.

A profile key incline 70 allows the profile key 20 to ride up and over internal upsets, such as a profile receiver 30 that does not match the profile key 20.

The profile keys 20 and the profile receivers 30 may be arranged in number of different configurations.

In an embodiment, each profile key 20 matches a single corresponding profile receiver 30 on a one-to-one basis. That is, each profile key 20 and the matching profile receiver 30 pair are unique. One profile key 20 would engage and actuate only one profile receiver 30.

In an embodiment, each profile key 20 matches one or more profile receivers 30 on a one-to-more-than-one basis. The matching profile receivers 30 may be arranged in groups or clusters, to provide multiple activations within an interval, for example to provide for a cluster frac. Each profile receiver 30 within a group or cluster would have the same profile, so that a matching profile key 20 would actuate all the profile receivers 30 within the group or cluster. One profile key 20 would engage and actuate more than one profile receiver 30.

Port Tool and Profile Selective Actuator Tool

Figure 2:
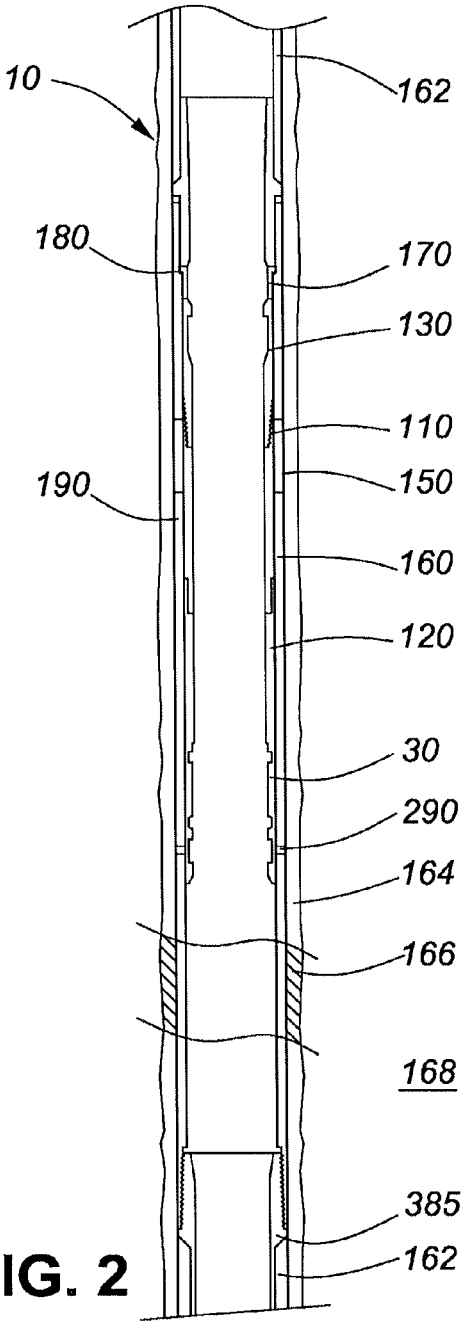
FIG. 2 is a cross-section of a port tool of the present disclosure, depicting a port closed position.
Figure 3:
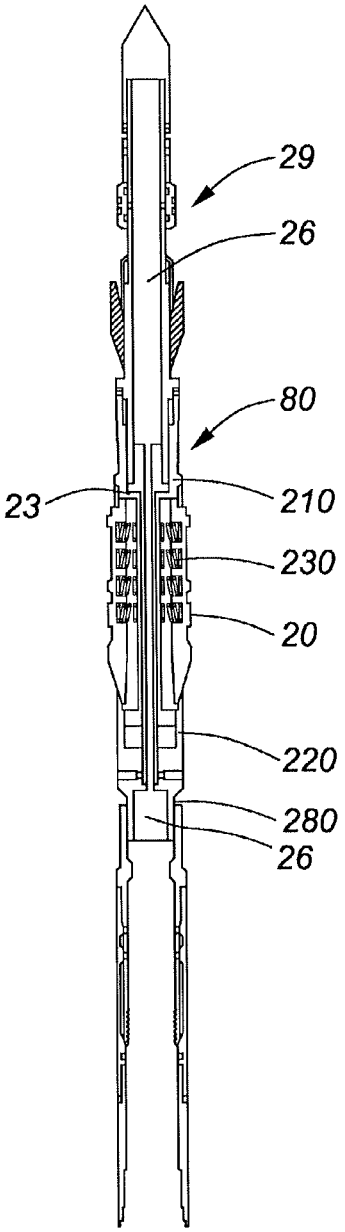
FIG. 3 is a cross-section of a profile selective actuator tool of the present disclosure.

Referring to FIGS. 2 and 3, the profile selective system 10 may be applied to a variety of downhole tools, such as a port tool 100, used for example in fracturing (fracing or frac) or pumping operations. A port tool 100 may also be commonly referred to as a frac sleeve.

The port tool 100 is positioned in the wellbore at a selected position in the formation 168.

The profile selective system may be used in an open hole packer configuration, a cemented application configuration, other configurations known to a person skilled in the art, or combinations thereof.

In an open hole packer configuration, one or more (usually many) port tools 100 may positioned in the wellbore with tubing or casing 162, and set in place using one or more open hole packers (see FIG. 16) with the open hole packers used to isolate sections of the wellbore. In a cemented application configuration, one or more (usually many) port tools 100 may be positioned in the wellbore with casing 162, and cemented in place with the casing 162 with cement 166 in the annular space 164 between the casing 162 and the tubular body 160 of the port tool 100 and the formation 168 with the cement 166 providing isolation (see inset FIG. 2 as an example).

The port tool 100 includes a tubular body 160 having at least one port 150. The port 150 is selectively closed by a valve sleeve 110 movable between a port closed position 130 (FIG. 2) and a port open position 140 (FIG. 12) by a valve sleeve assembly 120. The port tool 100 having the profile receiver 30 is activated using the profile selective tool actuator 80 having the profile key 20.

In an embodiment disclosed, the profile selective tool actuator 80 is configured as a dart. A profile key 20 is retained within a profile key body 210 and a key retainer 220. Springs 230 bias or urge the profile key 20 radially outward. The profile selective tool actuator 80 includes an actuator mandrel 23 having an actuator bore 26 there through and a bypass 29.

The valve sleeve assembly 120 includes detent 170 which engages a port closed groove 180 when the valve sleeve 110 is in the port closed position 130, and engages a port open groove 190 when the valve sleeve 110 is in the port open position 140. A profile receiver 30 is retained by the port tool 100, as part of the valve sleeve assembly 120 to operate the valve sleeve 110.

Figure 4:
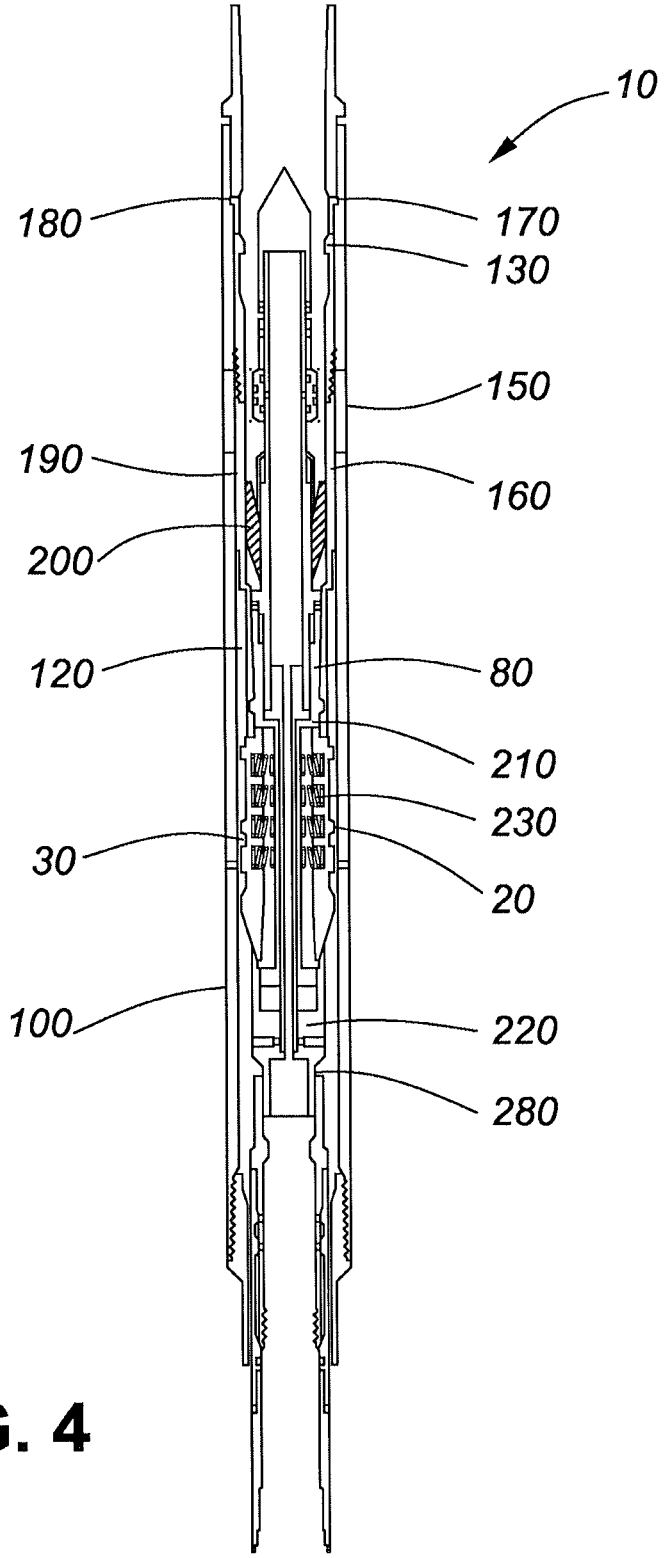
FIG. 4 is a cross-section of the profile selective actuator tool of FIG. 3 and the port tool of FIG. 2, depicting the profile selective actuator tool landed within the port tool.

In an embodiment disclosed, the profile selective tool actuator 80 may be conveyed down the well by fluid pressure. A cup 200 provides a seal between the profile selective tool actuator 80 and casing or tubing, as the case may be. As fluid pressure is applied from an uphole direction, the profile selective tool actuator 80 is conveyed downhole to land in the port tool 100 (see FIG. 4).

As the profile selective tool actuator 80 is conveyed downhole, the profile key 20 reaches a profile receiver 30. If the profile key 20 and the profile receiver 30 do not match or mate, then the profile key 20 and the profile receiver 30 do not engage and the profile selective tool actuator 80 will continue past the non-matching profile receiver 30, without activating the port tool 100.

However, if the profile key 20 and the profile receiver 30 match, then the profile key 20 and the profile receiver 30 mate or engage. That is, as the profile selective tool actuator 80 is conveyed downhole by pressure uphole from the cup 200, the profile key 20 engages and locks into the matching profile receiver 30.

Continued or increased fluid pressure behind the cup 200 may be used to activate the port tool 100. The valve sleeve assembly 120 is held in place relative to the tubular body 160 by a shear pin 290. Fluid pressure behind the cup 200 urges the profile selective tool actuator 80 downward with the valve sleeve assembly 120 releasing the detent 170 from the port closed groove 180, and the valve sleeve assembly 120 with the valve sleeve 110 slides axially to the port open position 140, and the detent 170 engages the port open groove 190. The valve sleeve 110 is thus secured in the port open position 140 (see FIG. 5).

In an embodiment disclosed, the profile selective tool actuator 80 provides a seal, isolating the downhole wellbore from the uphole wellbore. In an embodiment, the seal includes the cup 200.

In an embodiment, the profile selective tool actuator 80 remains in place for a period of time, with the profile key 20 and the matching profile receiver 30 engaged.

Port Tool Frac or Pumping Operation

Figure 5:
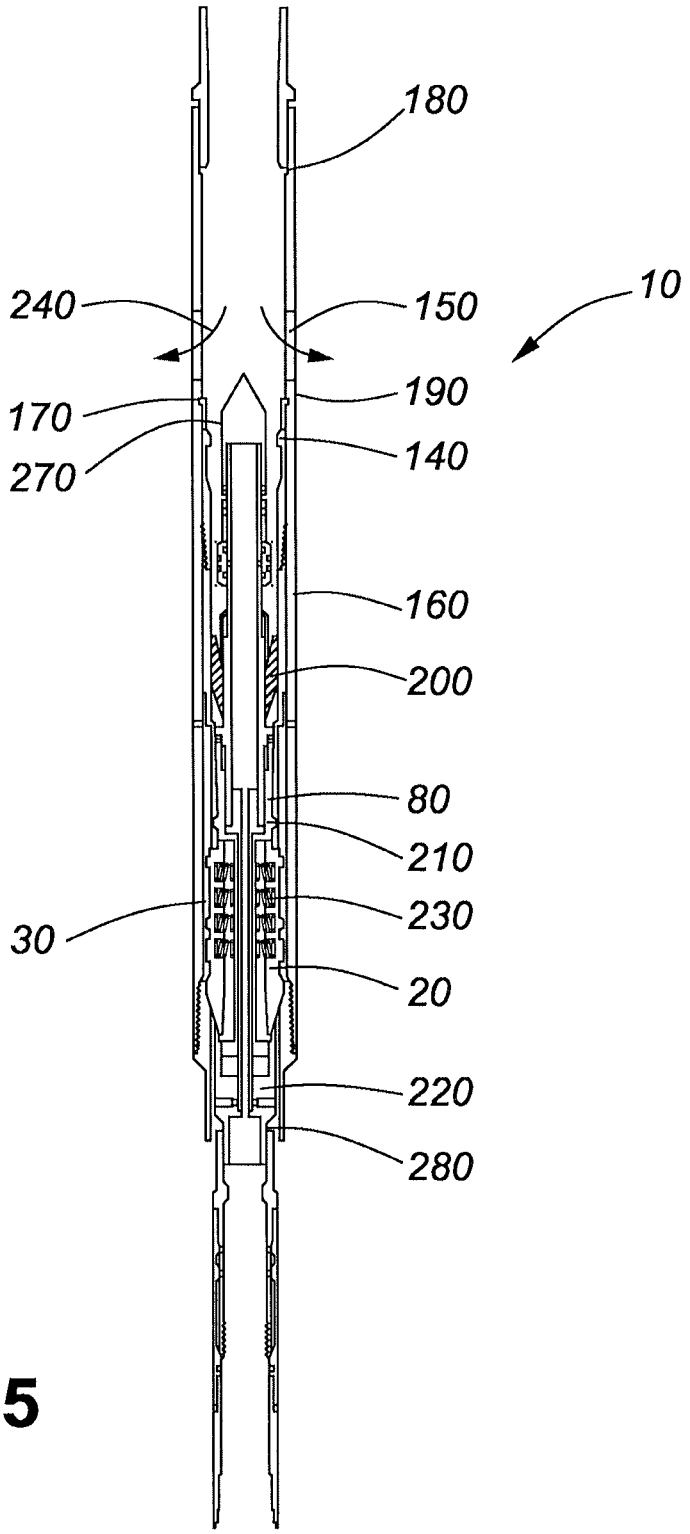
FIG. 5 is a cross-section of the profile selective actuator tool of FIG. 3 and the port tool of FIG. 2, depicting a port open position.

Referring to FIG. 5, the port tool 100 is shown with the valve sleeve 110 in the port open position 140, with the detent 170 engaging the port open groove 190. Thus, a relatively unrestricted flow path 240 is provided through the port 150. The frac or pumping operation may be conducted, for example by providing fluids or fluids and a proppant (for example sand) from the surface, via the casing or wellbore, and out through the port 150.

Release and Retrieve Profile Selective Tool

At the completion of the frac or pumping operation, the profile selective tool actuator 80 may be readily removed from the port tool 100, leaving a relatively unrestricted flow path through the casing.

Figure 6:
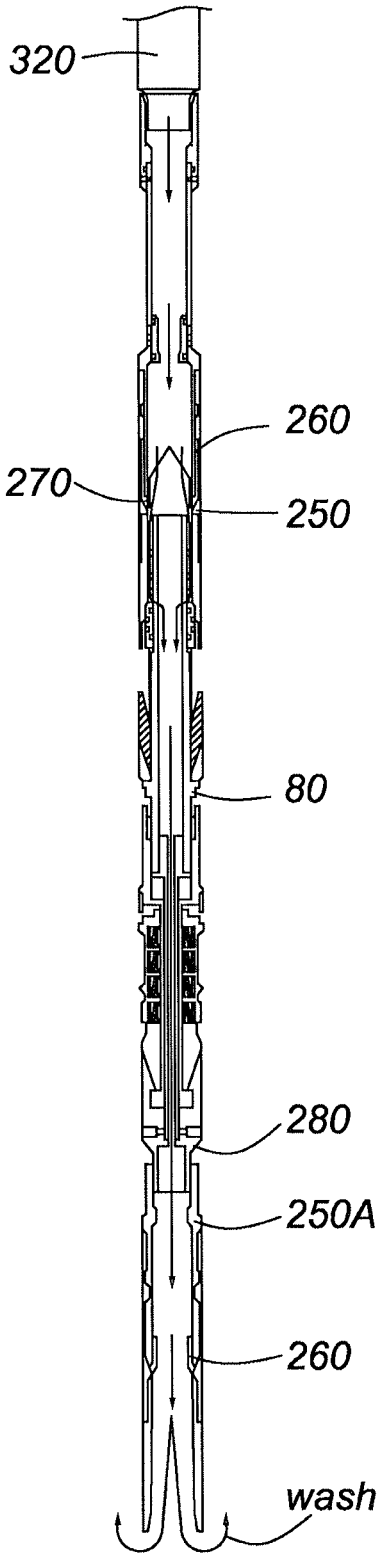
FIG. 6 is a cross-section of a retrieval tool (with a profile selective actuator tool attached)

Referring to FIG. 6, a retrieval tool 250 is used to release and retrieve the profile selective tool actuator 80. The downhole end of the profile selective tool actuator 80 includes a lower connector 280 with a retrieval tool 250A for engaging a downhole profile selective tool actuator 80. That is, the retrieval tool 250 may be used to pick up a profile selective tool actuator 80 and then that assembly may be used to pick up a further profile selective tool actuator 80 and so on because the bottom of the profile selective tool actuator 80 includes a retrieval tool 250A. The retrieval tool 250A may be integral with the profile selective tool actuator 80, or may be attached directly or indirectly below the profile selective tool actuator 80.

In an embodiment disclosed, the retrieval tool 250 may be run on tubing (jointed tubing or coiled tubing). The retrieval tool 250 can also be used to clean the uphole region of the port tool 100, for example to wash away any sand, proppant or other material. In an embodiment disclosed, fluid is circulated down the tubing, out the retrieval tool 250, and up the annular space between the tubing and the casing (or between the tubing and the open hole wellbore), to wash the uphole region of the profile selective tool actuator 80. Alternatively, fluid may be reverse circulated, down the annular space between the casing and tubing, and up the tubing.

The retrieval tool 250 (or retrieval tool 250A) includes retrieval tool teeth 260 which engage profile selective tool teeth 270 of the profile selective tool actuator 80. The teeth are fingered, having gaps between adjacent fingers, to allow fluid flow through the joint between the retrieval tool teeth 260 and the profile selective tool teeth 270.

Figure 7:
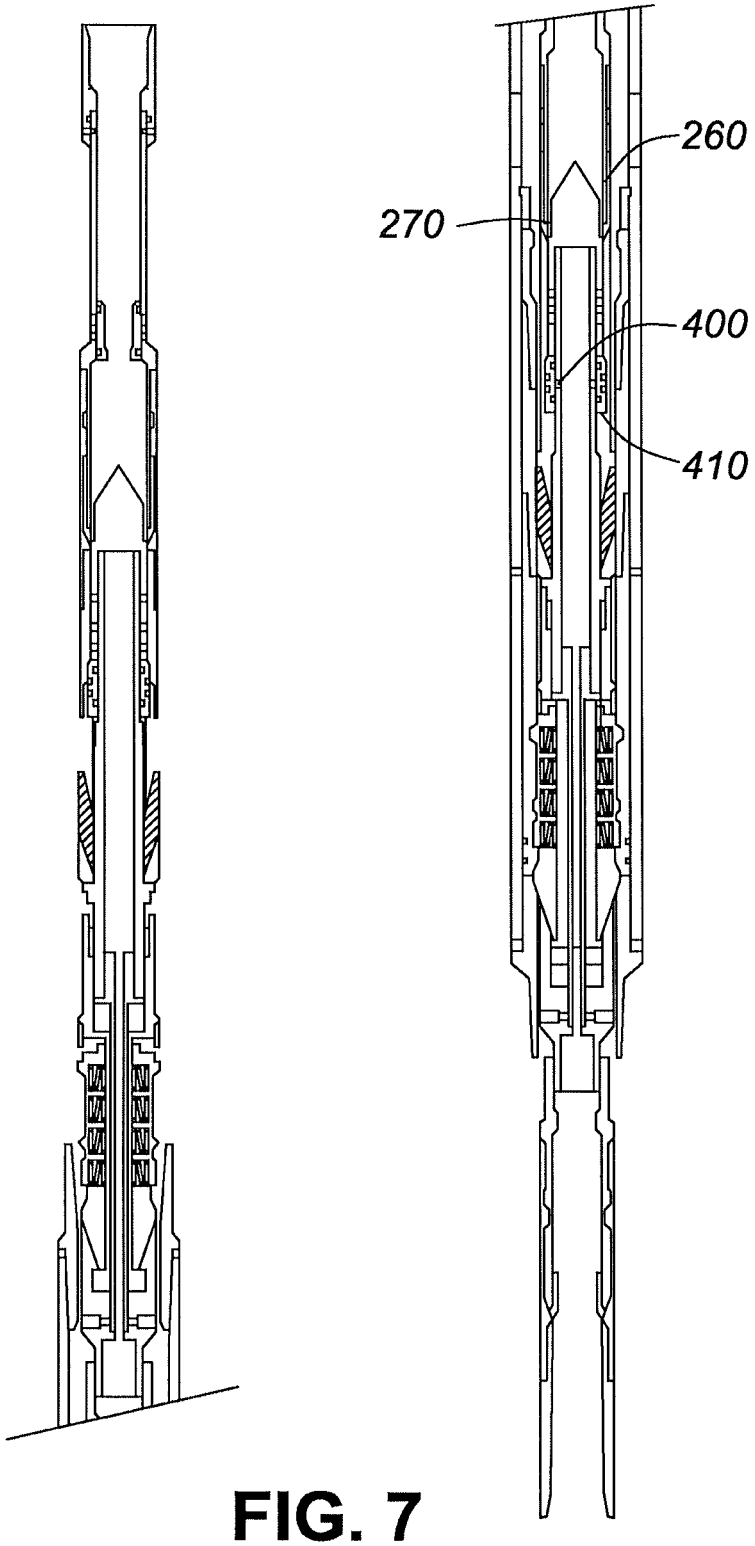
FIG. 7 is a cross-section of the retrieval tool of FIG. 6 and a profile selective actuator tool, depicting the retrieval tool latching onto the profile selective tool.
Figure 8:
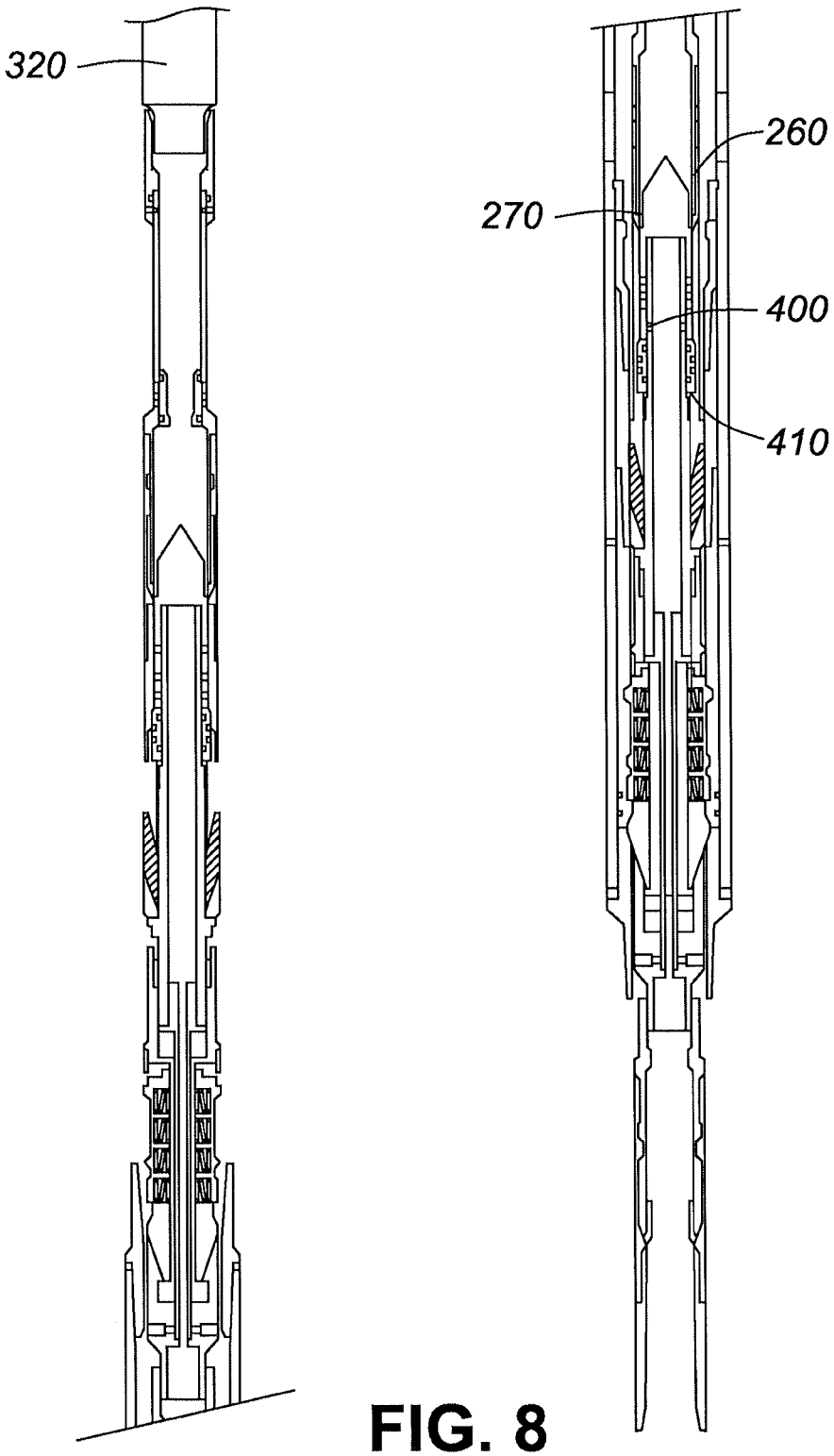
FIG. 8 is a cross-section of the retrieval tool of FIG. 6 and a profile selective actuator tool, depicting the retrieval tool fully latched onto the profile selective actuator tool.

Referring to FIGS. 7 and 8, as the retrieval tool teeth 260 fully engage the profile selective tool teeth 270 and as the retrieval tool 250 is pushed further downhole, a bypass port 400 is opened as a bypass valve sleeve 410 is forced down, relative to the profile selective tool actuator 80. With the bypass port 400 open (FIG. 8), fluid may be circulated down the tubing 320 through the retrieval tool 250, and as in FIG. 8, through port selective tool 80 and through another port selective tool actuator 80 and out the retrieval tool 250A for washing ahead of the assembly to help clean above the next port selective tool 80 being picked up.

Figure 9:
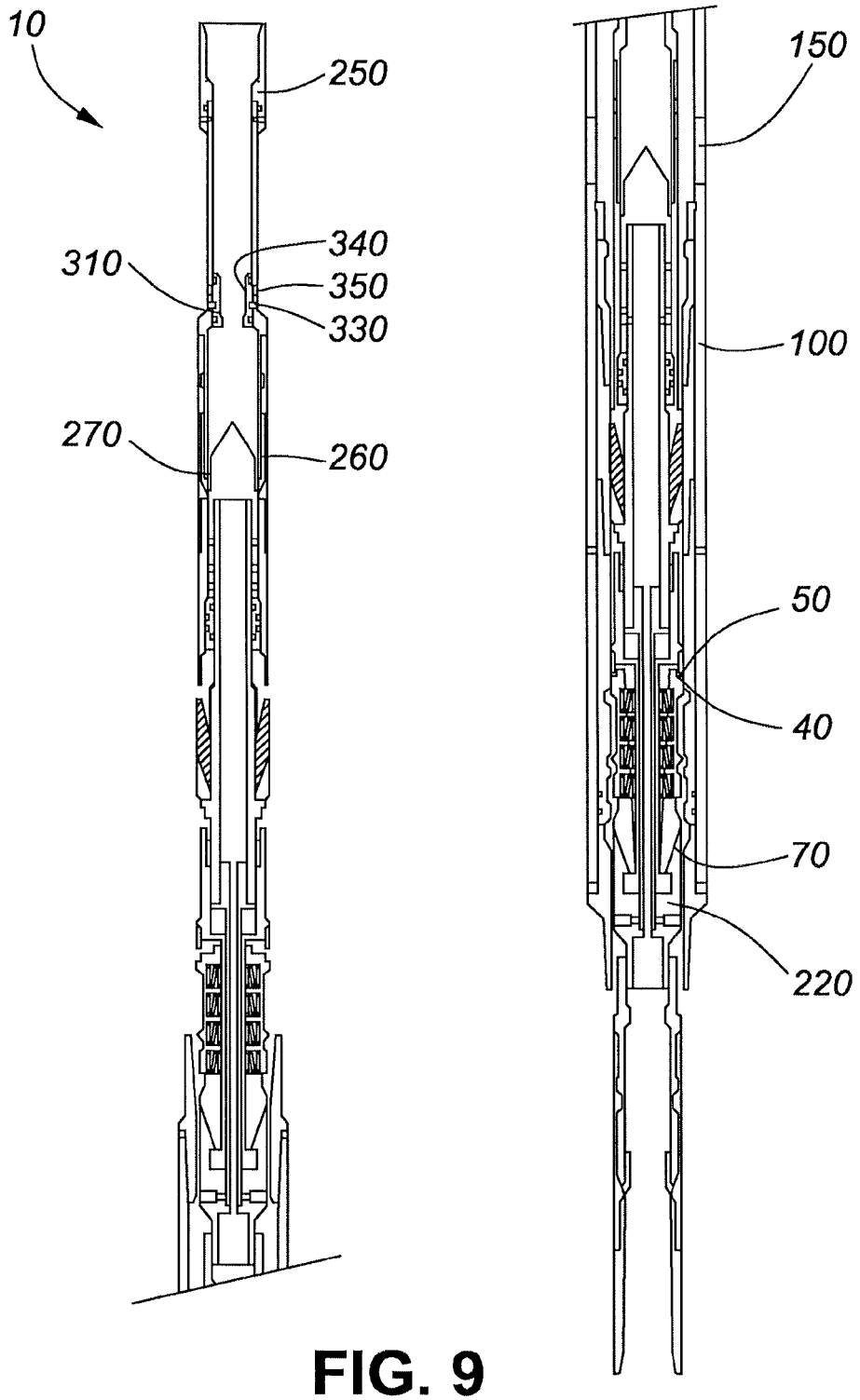
FIG. 9 is a cross-section of the retrieval tool of FIG. 6, profile selective actuator tool of FIG. 3, and port tool of FIG. 2, depicting release of the profile selective actuator tool.
Figure 10:
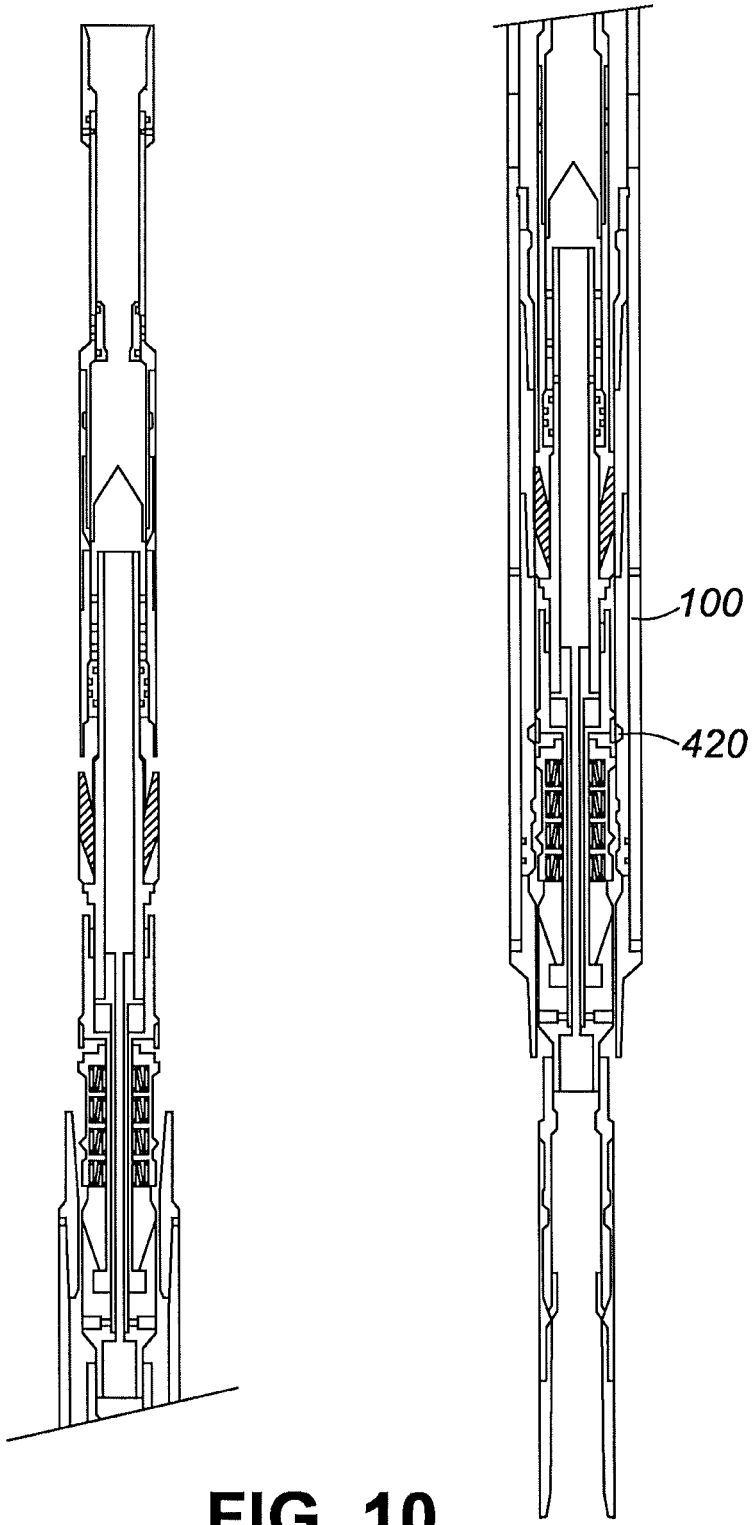
FIG. 10 is a cross-section of the retrieval tool of FIG. 6, profile selective actuator tool of FIG. 3, and port tool of FIG. 2, depicting retrieval of the profile selective actuator tool.

Referring to FIGS. 9 and 10, to release the profile selective tool actuator 80, tension is applied to the retrieval tool 250 and the key retainer 220 urged upward, putting a clamping force on the profile key incline 70, eventually pulling with it the profile key notch 40 out of the profile receiver notch 50 and forcing the key 20 into a locked down position. A latch 420 holds the profile key 20 in the locked down position. The retrieval tool 250 and the profile selective tool actuator 80 are then free to move axially relative to the port tool 100.

Figure 11:
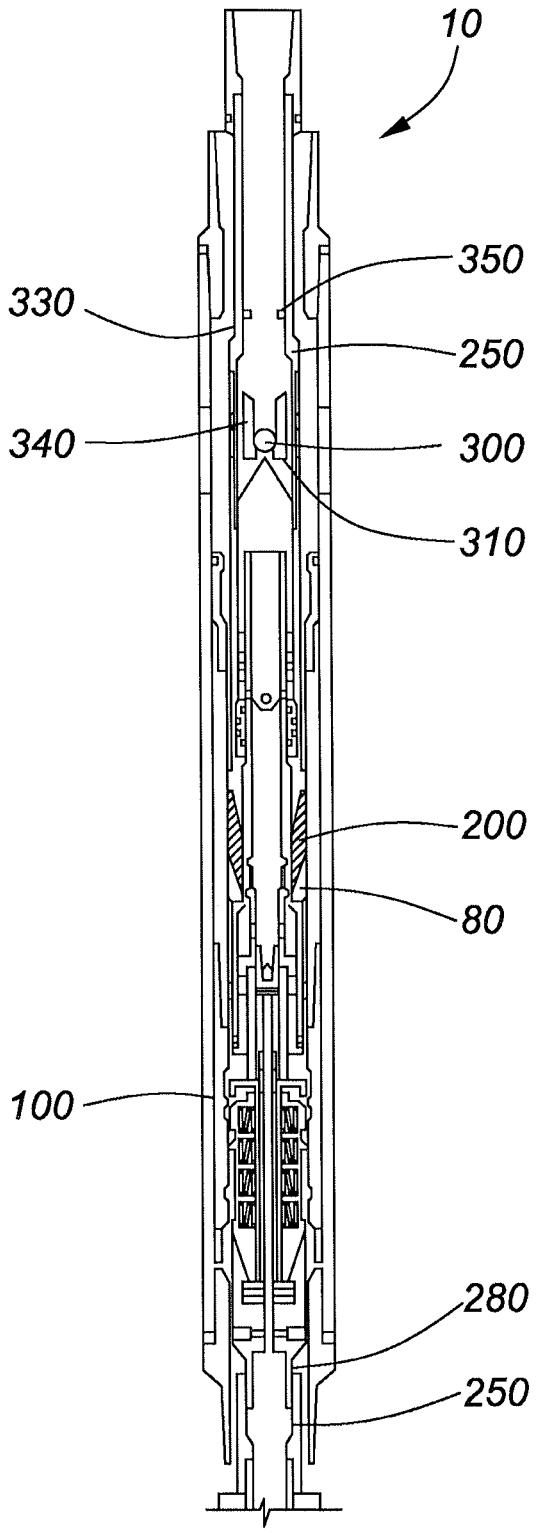
FIG. 11 is a cross-section of a retrieval tool, profile selective actuator tool, and a port tool, depicting retrieval of the profile selective actuator tool.

Referring to FIG. 11, to reduce a swabbing effect when the profile selective tool actuator 80 is pushed downhole or pulled uphole, a bypass port 350 is provided between the tubing and the annular space between the tubing and the casing or wellbore. A bypass sleeve 340 having a ball seat 310 is held in place with a shear pin 330 (see FIG. 6). A ball 300 is provided to the ball seat 310 to shear the shear pin 330 and operate bypass sleeve 340 to open the bypass port 350. A ball 300 may be dropped, pumped, or otherwise conveyed to the ball seat 310.

Figure 12:
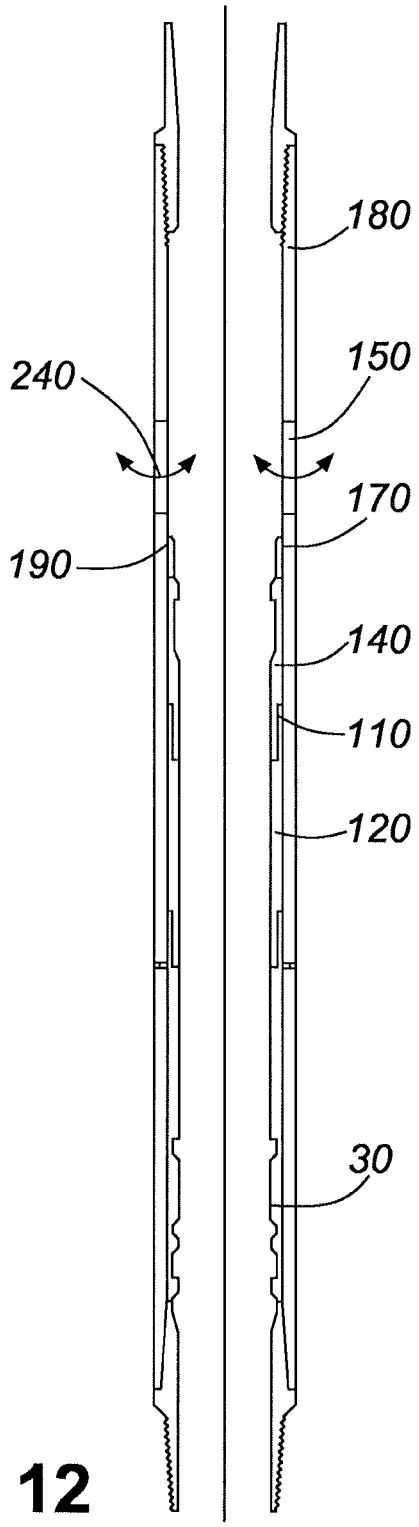
FIG. 12, is a cross-section of the port tool of FIG. 2, depicting a port open position.

Referring to FIG. 12, the retrieval tool 250 along with profile selective tool actuator 80 may then be pulled from the casing, leaving the port tool 100 in place, with the valve sleeve 110 in the port open position 140 with the port 150 open providing the flow path 240. Fluids from the formation, for example flow back and ultimately produced hydrocarbons may be produced via the flow path 240.

Flow Back Bypass and Cup Bypass

Figure 13:
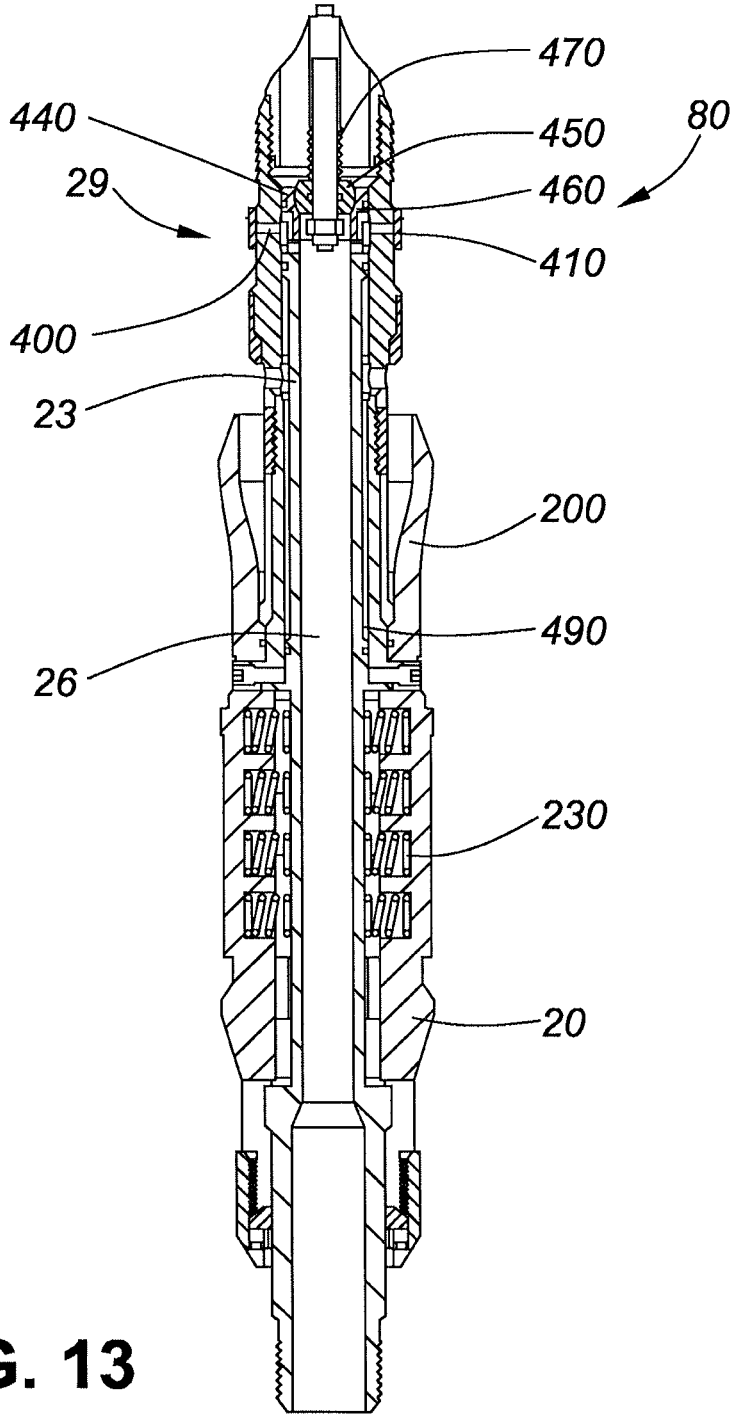
FIG. 13 is a cross-section of a profile selective actuator tool of the present disclosure in a running configuration.
Figure 14:
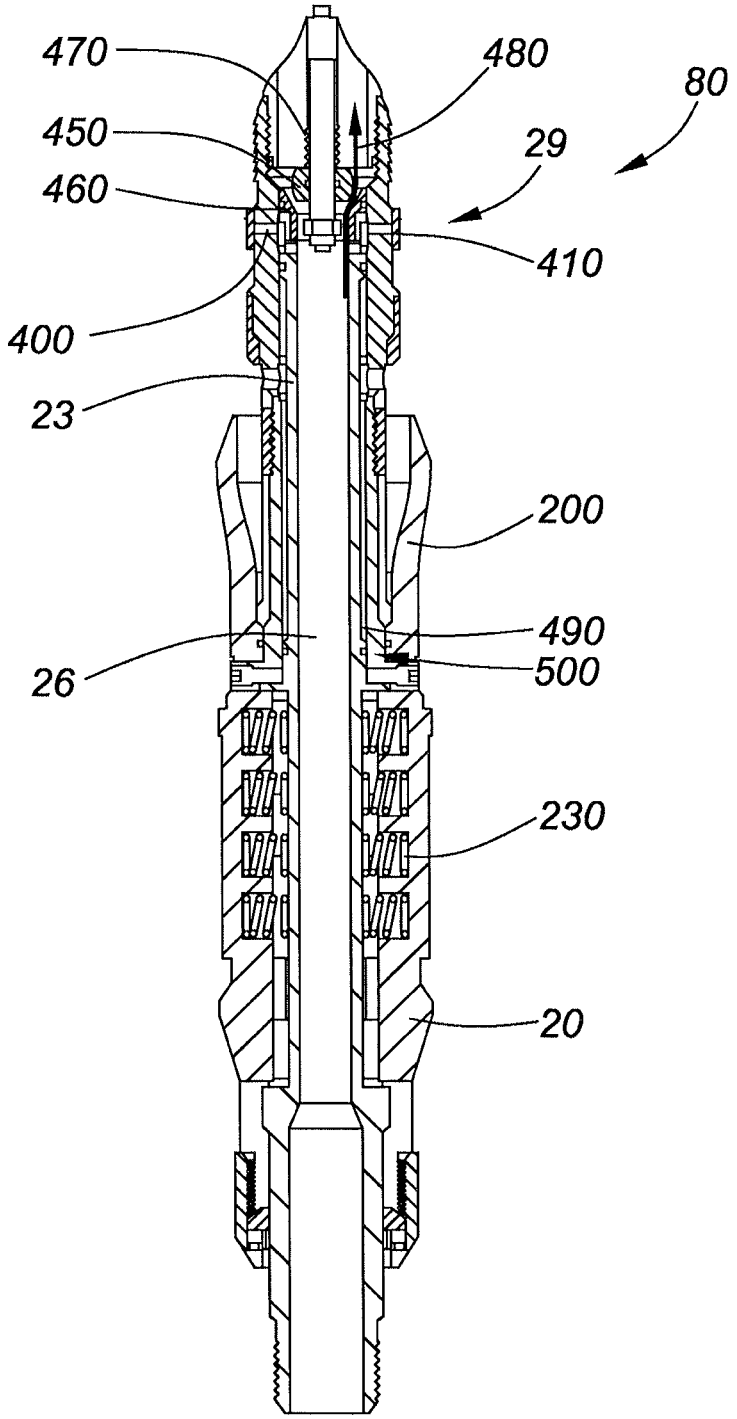
FIG. 14 is a cross-section of the profile selective actuator tool of FIG. 13, in a flow back configuration, depicting a flow back bypass in an open position.
Figure 15:
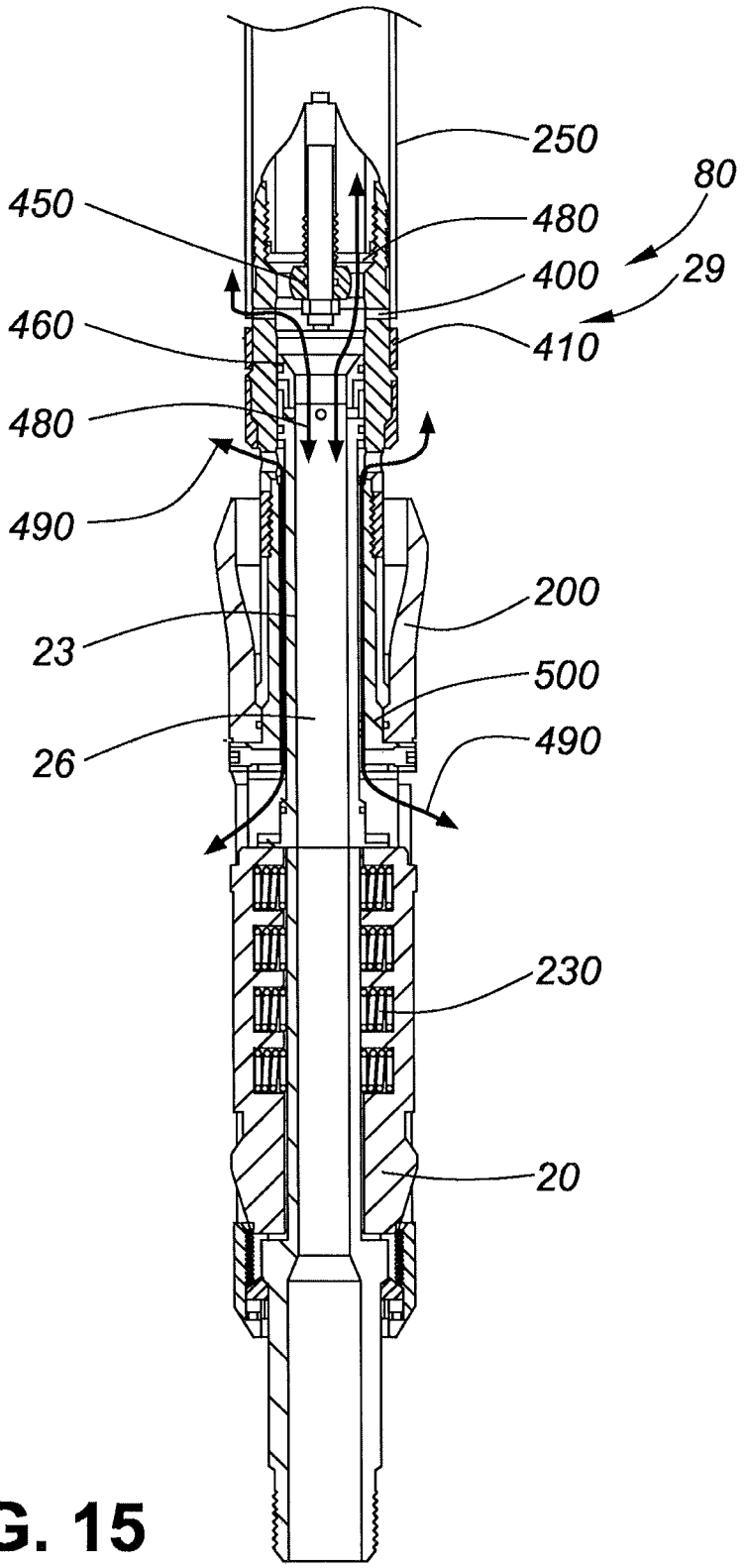
FIG. 15 is a cross-section of the profile selective actuator tool of FIG. 13, depicting the profile selective actuator tool in a released configuration, with the flow back bypass in an open position and the bypass open and a cup bypass open.

Referring to FIGS. 13-15, the profile selective tool actuator 80 may include a flow back bypass 440 which allows one or more zones downhole from the profile selective tool actuator 80, in this case a dart, to flow back (comingle) while the dart (profile key 20) is engaged in the profile receiver 30 prior to retrieval. This allows an operator to unload or cleanout the wellbore prior to retrieval of the profile selective actuator.

The flow back bypass 440 may include a poppet valve 450 biased toward a poppet valve seat 460, for example with a spring 470 to urge the poppet valve 450 into a closed position (FIG. 13). However, if sufficient fluid pressure is applied below the profile selective actuator 80, the force of the spring 470 is it least partially overcome, and the poppet valve 450 is moved from the closed position to an open position (FIG. 14) to allow fluids to flow back.

When the profile selective tool actuator 80 is released (see FIG. 14 and also FIGS. 9 and 10). The flow back bypass 440 may be locked in an open position (FIG. 14) which provides a fluid flow path 480 through the actuator bore 26 of the actuator mandrel 23. This could be used, for example, to circulate fluid through the retrieval tool 250 through the profile selective tool actuator 80 to wash below the profile selective tool actuator 80.

The bypass 29 allows fluid to flow past the cup 200 as the dart is moved uphole to reduce or prevent fluid resistance and swabbing effects (see also FIGS. 7 and 8). The bypass port 400 is opened as a bypass valve sleeve 410 is forced down, relative to the profile selective tool actuator 80. The bypass valve sleeve 410 may be held in the open position, for example, by friction or a ratchet mechanism. In addition, a cup bypass 490 allows fluid to flow past the cup 200 as the dart is moved uphole to reduce or prevent fluid resistance and swabbing effects. The cup bypass 490 is opened as the profile selective actuator 80 is released, for example as shown by relative movement between an upper actuator mandrel 500 and the actuator mandrel 23.

The disclosed profile selective tool actuator 80 and the port tool 100 are versatile and may be used in different configurations.

Multi-Stage Frac or Pumping Operation

In an embodiment disclosed, one profile selective tool actuator 80 having a profile key 20 is used to actuate one port tool 100 having a profile receiver 30 which matches the profile key 20, i.e. one to one.

In a multi-stage frac or pumping operation, one or more, usually several port tools 100 may be used at one time. The actuation process and frac or pumping operation can be repeated for a number of port tools 100 using a corresponding number of profile selective tools 80, i.e. one to one.

Each port tool 100 has a profile receiver 30, and each profile selective tool actuator 80 has a profile key 20. The profile selective tool actuator 80 is conveyed down the well to activate a corresponding port tool 100, and then the frac or pumping operation repeated, stage by stage. The profile selective tools 80 are provided sequentially, starting at the downhole or toe end of the well, with the profile key 20 matching the receiver 30, and repeating the process one by one continuing uphole, until all of the port tools 100 have been actuated, and the frac or pumping operation has been completed at each stage with the port tools 100.

Figure 16:
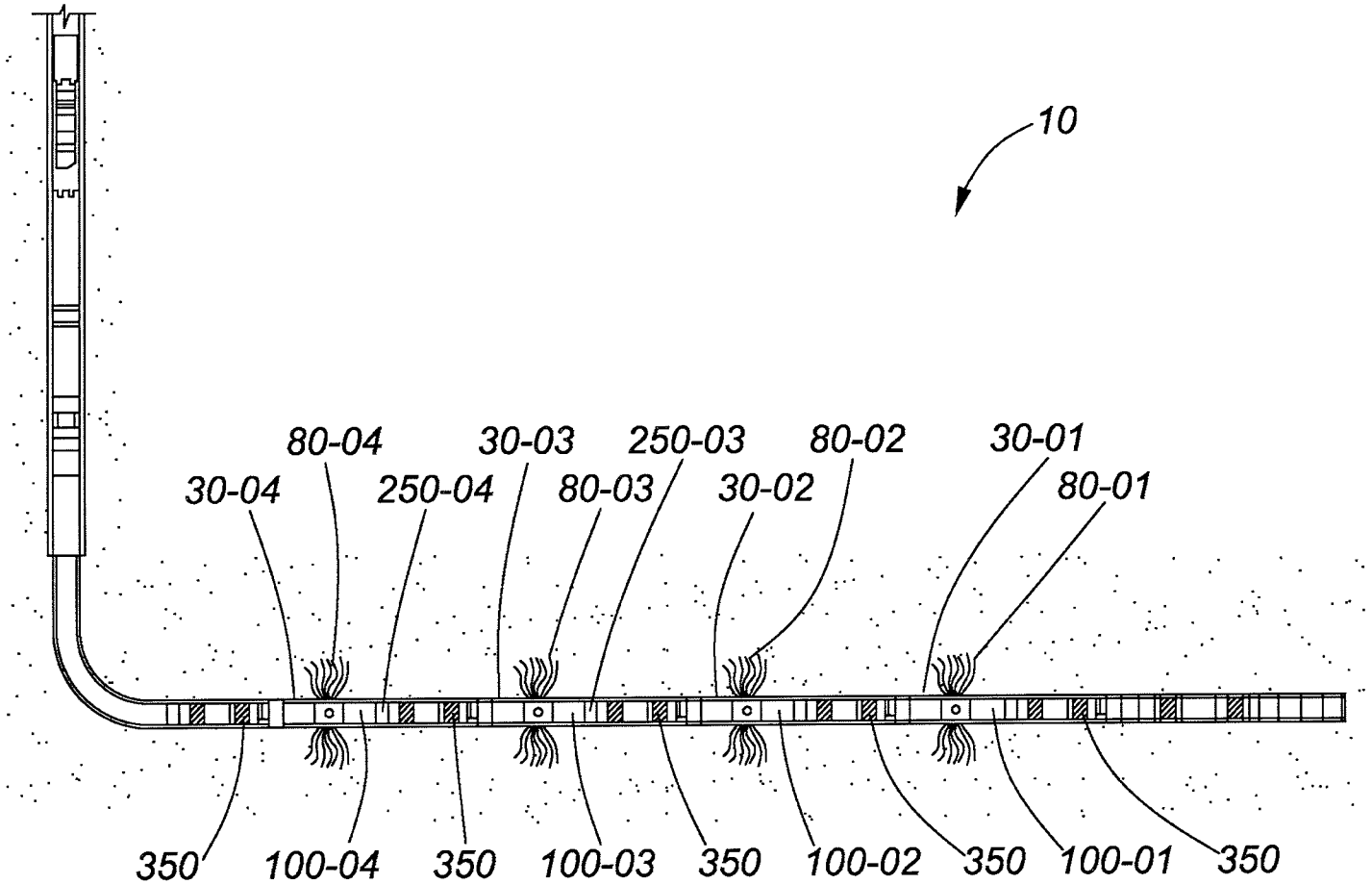
FIG. 16 is a simplified depiction of a multi-stage frac using the port tool of FIG. 2 and the profile selective actuator tool of FIG. 3.

Referring to FIG. 16, a multi-stage frac or pumping operation may use one or more port tools 100. Four are shown, but many port tools 100 may be used for a multi-stage frac or pumping operation. The port tools 100 are set in place (here in an open-hole configuration, set using packers 360, for example hydraulic or hydrostatic set open hole packers). However, as described previously, the profile selective system, here with port tools 100, may also be used in cemented applications, with cement placed between in the annular space between the port tool 100 and the formation for isolation rather than using open hole packers.

The port tools 100 are spaced apart in the wellbore (with open hole packers or cemented or combinations thereof). Each port tool 100 has a profile receiver 30 which is unique. For example, port tool 100-01 has a profile receiver 30-01, port tool 100-02 has a profile receiver 30-02, port tool 100-03 has a profile receiver 30-03, and port tool 100-04 has a profile receiver 30-04. If more stages were used, the series would continue to the number of stages.

Each port tool 100 having a profile receiver 30 has a corresponding profile selective tool actuator 80, having a profile key 20 matching the profile receiver 30, i.e. profile key 20-01 for profile receiver 30-01, profile key 20-02 for profile receiver 30-02, profile key 20-03 for profile receiver 30-03, and profile key 20-04 for profile receiver 30-04. If more stages were used, the series would continue to the number of stages. As is known to one skilled in the art, such systems may include one or more additional port tools, downhole from the port tool 100-01, and such one or more additional port tools may be actuated (opened) by other means, for example hydraulically.

As described previously, the profile key 20 will pass through a non-matching profile receiver 30, but will engage when it encounters a matching profile receiver 30. Thus, the profile selective tools 80 can be conveyed sequentially from surface to selectively actuate a downhole device, such as one or more port tools 100.

The profile selective tool actuator 80-01 having profile key 20-01 may be pumped down the casing, and will pass through port tool 100-04 (receiver 30-04), pass through port tool 100-03 (receiver 30-03), pass through port tool 100-02 (receiver 30-02), and engage port tool 100-01 (receiver 30-01), to open the port 150-01 (FIG. 5) of the port tool 100-01. With the port 150 open, a well operation may be conducted, for example conveying a fracturing fluid down the well, through the port 150 and into the formation, and propagating fractures in the formation proximate the port tool 100-01.

The profile selective tool actuator 80-02 having profile key 20-02 may be pumped down the well, and will pass through port tool 100-04 (receiver 30-04), pass through port tool 100-03 (receiver 30-03), and engage port tool 100-02 (receiver 30-02), to open the port 150 (FIG. 5) of the port tool 100-02. With the port 150-02 open, a well operation may be conducted, for example conveying a fracturing fluid down the well, through the port 150 and into the formation, and propagating fractures in the formation proximate the port tool 100-02.

The profile selective tool actuator 80-03 having profile key 20-03 may be pumped down the well, and will pass through port tool 100-04 (receiver 30-04), and then engage port tool 100-03 (receiver 30-03), to open the port 150-03 (FIG. 5) of the port tool 100-03. With the port 150 open, a well operation may be conducted, for example conveying a fracturing fluid down the well, through the port 150 and into the formation, and propagating fractures in the formation proximate the port tool 100-03.

The profile selective tool actuator 80-04 having profile key 20-04 may be pumped down the well, and engage port tool 100-04 (receiver 30-04), to open the port 150-04 (FIG. 5) of the port tool 100-04. With the port 150 open, a well operation may be conducted, for example conveying a fracturing fluid down the well, through the port 150 and into the formation, and propagating fractures in the formation proximate the port tool 100-04.

With the staged operation complete, the profile selective tools 80 (in this four-stage example, 80-04, 80-03, 80-02, and 80-01) may be retrieved. In an embodiment disclosed, the profile selective tools (for example 80-04, 80-03, 80-02, and 80-01) may be retrieved sequentially, one at a time, by repeating the release and retrieval steps as above. In, for example a 20 stage operation, this would require 20 trips.

In an embodiment disclosed, the profile selective tools (for example 80-04, 80-03, 80-02, and 80-01) may be retrieved sequentially, two or more at a time, by using the release and retrieval steps as below. In, for example a 20 stage operation, with several profile selective tools 80 retrieved per trip, the entire 20 may be retrieved in as little as one trip, but more typically four or five profile selective tools 80 would be retrieved per trip.

Rapid Configuration or Cluster Frac

Figure 17:
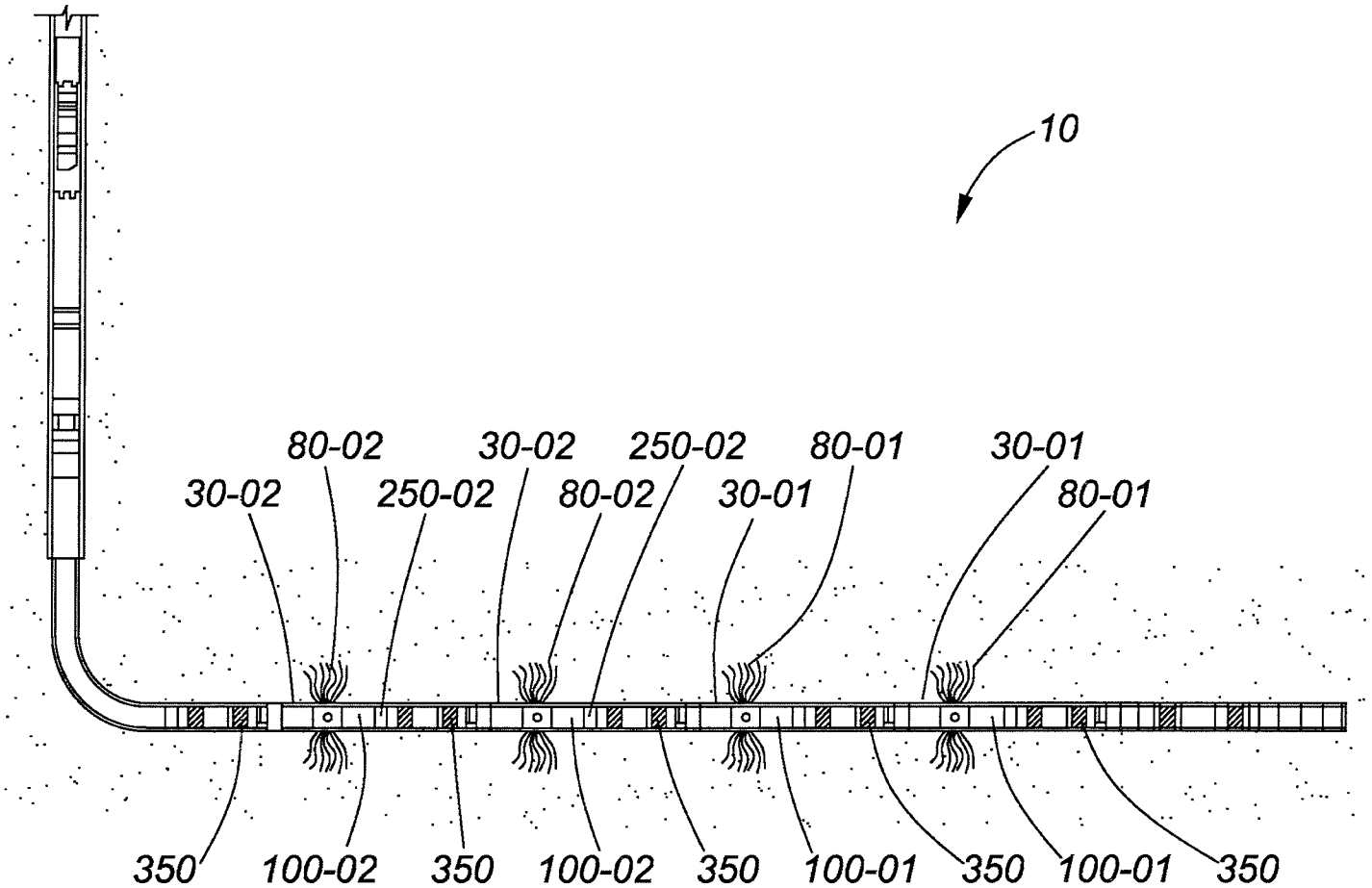
FIG. 17 is a simplified depiction of a cluster frac using the port tool of FIG. 2 and the profile selective actuator tool of FIG. 3.

Referring to FIG. 17, in a further embodiment disclosed, herein referred to as a rapid configuration or cluster frac, one tool having a profile key 20 is used to actuate a plurality of downhole tools having a profile receiver 30 which matches the profile key 20, i.e. one to several. The matching profile receivers 30 are grouped or clustered together, and actuated by the matching profile key 20.

In an embodiment disclosed, one tool having a profile key 20 may be used to actuate, for example, five (5) port tools

100 arranged along a wellbore, each port tool 100 having a receiver 30 which matches the profile key 20.

For simplicity, FIG. 17 depicts only clusters of two, and only two such clusters. However, this is but one example. It is not necessary that the port tools 100, having the common key be sequential. Nor is it necessary that there only be two port tools 100 per cluster. In an embodiment disclosed, between 2 and 7 port tools 100, having a common profile key 20 are arranged in groups or clusters, and each group or cluster is actuatable as a group or cluster by a matching profile key 20.

In this configuration, the profile key 20 of the profile selective tool actuator 80 engages the profile receiver 30 of the first port tool 100, actuates the first port tool 100 (as described above), and then the profile key 20 and the profile receiver 30 disengage and the profile selective tool actuator 80 continues downhole to actuate any other port tool 100 having a profile receiver 30 which match the profile key 20. In the example shown, the profile selective tool actuator 80 continues downhole and the profile key 20 of the profile selective tool actuator 80 engages the profile receiver 30 of the second port tool 100, and actuates the second port tool 100 (as described above).

Referring to FIG. 17, the Rapid Configuration is depicted in a simplified manner, with only two groups of two port tools 100. The profile selective tool actuator 80 having the profile key 20 which matches the profile receiver 30 actuates the port tools 100 within the cluster. Once the port tool 100 is actuated, for example, by movement of the valve sleeve 110 into the port open position 140, the profile key 20 and the profile receiver 30 disengage.

Referring to FIG. 17, as an example, a profile selective tool actuator 80-01 having the profile key 20-01 would activate the cluster of port tools 100-01 having the profile receiver 30-01. A well operation may then be conducted, for example conveying a fracturing fluid down the well, into the formation, and propagating fractures in the formation proximate the cluster of port tools 100-01.

Then a profile selective tool actuator 80-02 having the profile key 20-02 would activate the cluster of port tools 100-02 having the profile receiver 30-02. A well operation may then be conducted, for example conveying a fracturing fluid down the well, into the formation, and propagating fractures in the formation proximate the cluster of port tools 10002.

Figure 19:
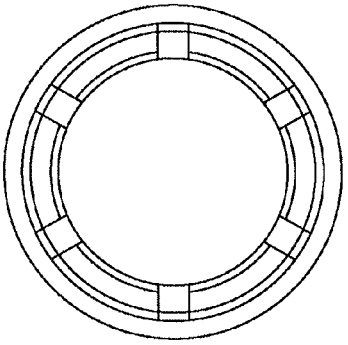
FIG. 19 is a cross-section of the kick over sub of FIG. 18.
Figure 18:
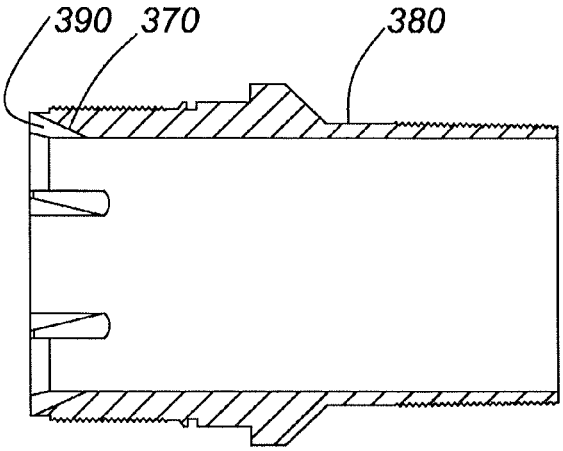
FIG. 18 is an end view of a kick over sub of the port tool of FIG. 2.

Referring to FIGS. 18, 19, in an embodiment disclosed, the port tool 100 includes a key release 370. The key release 370 may be provided by a kick over sub 380, or otherwise incorporated into the port tool 100 (FIG. 2). As the valve sleeve 110 reaches the port open position 140, the profile key incline 70 engages a step 390 of the kick over sub 380 and the profile key 20 and the profile receiver 30 are disengaged, allowing the profile selective tool actuator 80 to continue its travel downward, past the port tool 100 (and on to actuate any other port tool(s) further downhole having a profile receiver 30 which matches the profile key 20).

Figure 20:
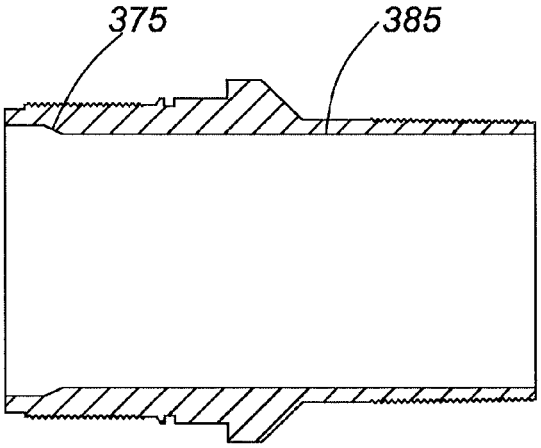
FIG. 20 is a cross-section of a key stop sub of the port tool of FIG. 2.

In contrast, referring to FIG. 20, the port tool 100 may include a key stop 375. The key stop 375 may be provided by a key stop sub 385, or otherwise incorporated into the port tool 100. As the valve sleeve 110 reaches the port open position 140, the key stop 375 does not disengage the profile key 20 and the profile receiver 30, so the profile selective tool actuator 80 does not continue its travel downward.

Rapid Multi-Stage Frac or Pumping Operation

In an embodiment disclosed, a stop 430 is provided near the end of the wellbore to retain the profile selective tool actuator 80 within the casing. In an embodiment disclosed, the stop 430 may be provided by providing a bridge plug, packer or other obstruction at a downhole end of the wellbore.

In an embodiment disclosed, the stop 430 may be provided by providing a port tool 100-01 having a profile receiver 30-01 within the casing, keyed to a profile key 20-01 of the first profile selective tool actuator 80-01, the port tool 100-01 including a key stop sub 385-01.

Re-Entry or Future Operation

Figure 21:
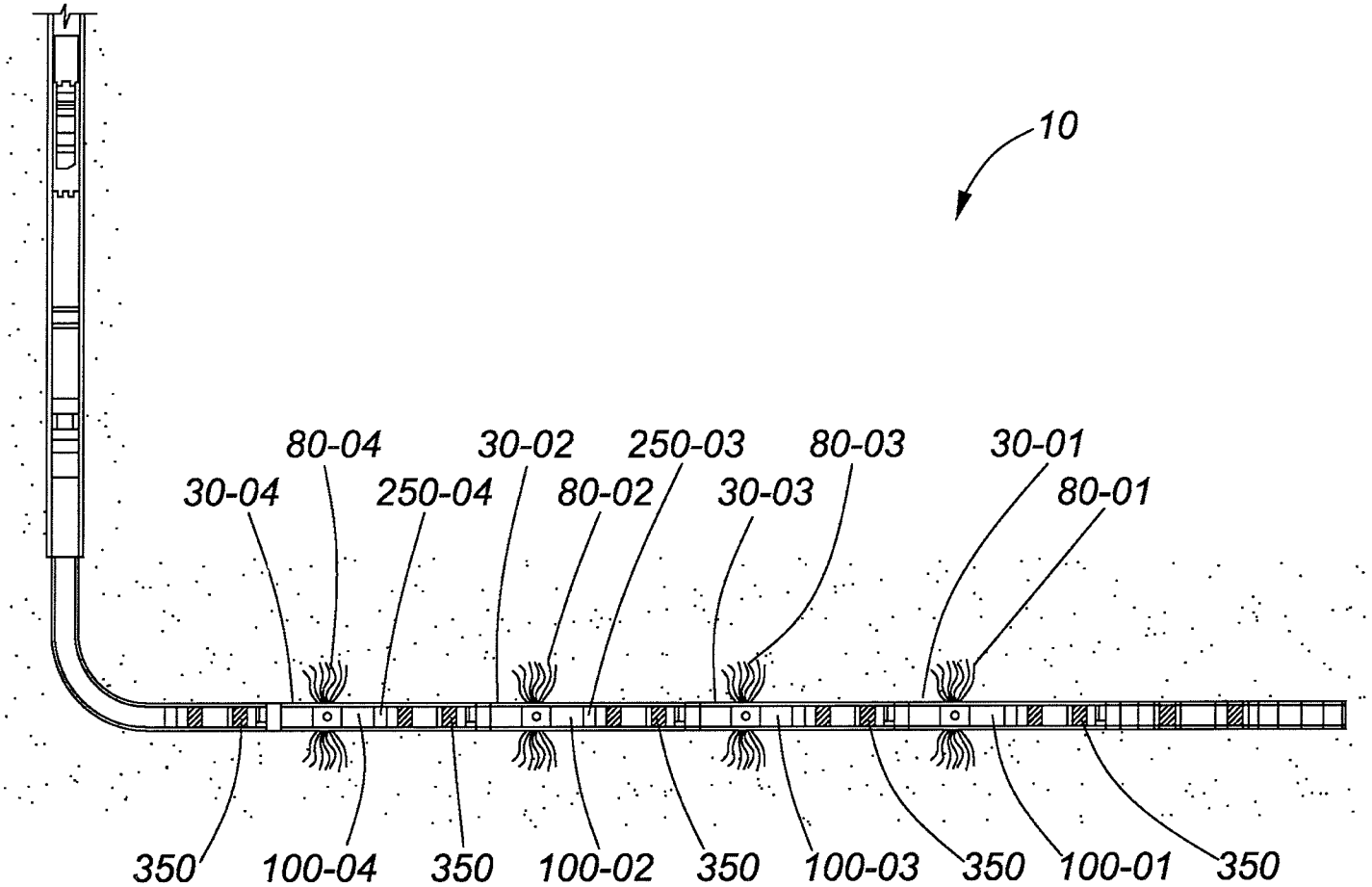
FIG. 21 is a simplified depiction of a re-entry setup using the port tool of FIG. 2 and the profile selective actuator tool of FIG. 3.

Referring to FIG. 21, in an embodiment disclosed, a plurality of port tools 100 may be spaced apart along an interval of the wellbore for use as described above, and a plurality of redundant or back-up port tools 100 reserved for re-entry or other future operation provided adjacent or proximate one or more of the plurality of port tools 100. This provides additional operational flexibility.

Port tools 100-01 and 100-02 are provided as described above. However, re-entry port tools 100-03 and 100-04 are provided respectively adjacent to the port tools 100-01 and 100-02. A profile selective tool actuator 80-01 having the profile key 20-01 would activate the port tools 100-01 having the matching profile receiver 30-01, and a profile selective tool actuator 80-02 having the profile key 20-02 would activate the port tool 100-02 having the matching profile receiver 30-02. Each of the port tools 100-03 and 100-04 would be available for re-entry at some point in the future, through the use of a profile selective tool actuator 80-03 or 80-04 having the corresponding matching profile key 20-03 or 20-04.

Multi-Trip Retrieval

In an embodiment disclosed, a single profile selective tool actuator 80 may be retrieved in one trip. A retrieval tool 250 is run in the well from surface, for example on jointed tubing or coiled tubing (CT), and engages profile selective tool actuator 80 to release the profile selective tool actuator 80 from the port tool 100 as described above. Fluid may be circulated through the tubing, and through and out the retrieval tool 250 to clean sand or debris or both ahead of the retrieval tool 250. Once the retrieval tool 250 engages the profile selective tool actuator 80, and the bypass port 400 opened, fluid may be circulated through and out the profile selective tool actuator 80 to clean sand/debris ahead of the (now connected) retrieval tool 250 and the profile selective tool actuator 80.

Referring to FIG. 16, for example, in an embodiment disclosed, the retrieval tool 250 may be run repeatedly to pull each of the profile selective tools 80 individually. That is, in a first trip the profile selective tool actuator 80-04 is retrieved. Then in a further trip, the profile selective tool actuator 80-03 is retrieved, and so on, one at a time.

Single-Trip Retrieval

In an embodiment disclosed, two or more profile selective tools 80 may be retrieved in one trip. It is not necessary to retrieve all the profile selective tools 80 in one trip, but in an embodiment disclosed several profile selective tools 80 may be removed in a single trip.

The downhole end of the profile selective tool actuator 80 includes a lower connector 280 connecting a retrieval tool 250A (see FIG. 6) for engaging a downhole profile selective tool actuator 80. The retrieval tool 250A may be integral with the profile selective tool actuator 80, or may be attached directly or indirectly below the profile selective tool actuator 80. In FIG. 6, the retrieval tool 250A is shown attached to the lower connector 280 of the profile selective tool actuator 80.

The retrieval tool 250 is run into the well to latch onto and release the profile selective tool actuator 80 from the port tool 100. Fluid may be circulated through the tubing, and through and out the retrieval tool 250 to clean sand/debris ahead of the retrieval tool 250. Once the retrieval tool 250 engages the profile selective tool actuator 80, and the bypass port 400 opened, fluid may be circulated through and out the profile selective tool actuator 80 to clean sand or debris or both ahead of the (now connected) retrieval tool 250 and the profile selective tool actuator 80. This may be repeated for one or more additional profile selective tool actuators 80 to provide single-trip retrieval.

In FIG. 16, in a simplified example, a retrieval tool 250A is attached to the lower end of the profile selective tool actuator 80 prior to conveying the profile selective tool actuator 80 down the well in order to facilitate single-trip retrieval. A retrieval tool 250A-04 is connected below profile selective tool actuator 80-04, a retrieval tool 250A-03 is connected below profile selective tool actuator 80-03, and a retrieval tool 250A-02 is connected below profile selective tool actuator 80-02. There is no need for the profile selective tool actuator 80-01 to include a retrieval tool.

To retrieve multiple profile selective tool actuators 80 in a single-trip, the retrieval tool 250 is run into the well to latch onto and release the profile selective tool actuator 80-04 from the port tool 100. Fluid may be circulated through the tubing, and through and out the retrieval tool 250 to clean sand/debris ahead of the retrieval tool 250, i.e. above the profile selective tool actuator 80-04 (see for example, FIG. 6).

Once the retrieval tool 250 engages the profile selective tool actuator 80-04, and the bypass 400-04 opened, fluid may be circulated through and out the profile selective tool actuator 80-04 and the retrieval tool 250A-04 to clean sand/debris ahead of the (now connected) retrieval tool 250 and the profile selective tool actuator 80-04, i.e. above the profile selective tool actuator 80-03. These steps may be repeated a number of times to retrieve several profile selective tools 80 in one trip. At each step or stage, fluid may be circulated through the tubing, retrieval tool 250, and profile selective tools 80 to clean sand/debris ahead of this assembly (and above the next profile selective tool actuator 80).

The retrieval tool 250 and the profile selective tool actuator 80-04 are moved down and the retrieval tool 250A-04 is used to pick up profile selective tool actuator 80-03 (released as described above). As above, fluid may be circulated through the profile selective tool actuator 80-04, the retrieval tool 250A-04, the profile selective tool actuator 80-03, and out the retrieval tool 250A-03 to clean sand/debris ahead of the now connected, retrieval tool 250, the profile selective tool actuator 80-04, and the profile selective tool actuator 80-03.

The retrieval tool 250 and the profile selective tools 80-04 and 80-03 are moved down and the retrieval tool 250A-03 used to pick up profile selective tool actuator 80-02 (released as described above). Fluid may be circulated through the tubing, retrieval tool 250, and profile selective tool actuators 80-04 and 80-03 to clean sand or debris or both ahead of this assembly.

Then the retrieval tool 250 and the profile selective tool actuators 80-04, 80-03, and 80-02 are moved down and the retrieval tool 250A-02 used to pick up profile selective tool actuator 80-01 (released as described above). Fluid may be circulated through the tubing, retrieval tool 250, and profile selective tool actuators 80-04, 80-03, and 80-02 to clean sand or debris or both ahead of this assembly.

Then the entire string can then be removed from the wellbore. In this example, retrieval tool 250, profile selective tool actuator 80-04 (with retrieval tool 250A-04), profile selective tool actuator 80-03 (with retrieval tool 250A-03), profile selective tool actuator 80-02 (with retrieval tool 250A-02), and profile selective tool actuator 80-01, may be retrieved from the well in a single-trip. This example with four stages is only an example, and in an embodiment disclosed many stages may be retrieved in this manner.

Further Options

In an embodiment disclosed, the valve sleeve 110 may be shifted from the open position 140 to the closed position 130 using a designated shifting tool, after fracturing, for example to shut off production flow. In an embodiment disclosed, the valve sleeve 110 may be re-opened from the closed position 130 to the open position 140 with a designated shifting tool. In an embodiment disclosed the designated shifting tool has a profile key 20 adapted to engage the profile receiver 30 associated with the valve sleeve 110, such as a profile selective tool actuator 80 described herein.

The above-described embodiments are intended to be examples only. Alterations, modifications and variations can be effected to the particular embodiments by those of skill in the art without departing from the scope, which is defined solely by the claims appended hereto.

What is claimed is:

1. A profile selective system for actuating downhole valves comprising:

a tubular string comprising multiple joints of a wellbore tubular, a first downhole valve and a second downhole valve;

wherein the first downhole valve comprises a piston mounted in a valve body, the piston moveable between a closed position covering one or more flow ports and an open position exposing the flow ports for flow through the valve body, and a first key profile located on the interior of the piston, the first key profile adapted to actuate the first downhole valve;

wherein the second downhole valve is spaced apart and uphole relative to the first downhole valve and comprises a piston mounted in a valve body, the piston moveable between a closed position covering one or more flow ports and an open position exposing the flow ports for flow through the valve body, and a second key profile located on the interior of the piston, the second key profile adapted to actuate the second downhole valve;

a first actuator tool comprising a first corresponding profile adapted to selectively engage the first key profile but not the second key profile, the first actuator tool further comprising an exterior seal for sealing against the piston in the first downhole valve thereby isolating the tubular string downhole of the first downhole valve when the first actuator tool is landed in the first downhole valve; and a second actuator tool comprising a second corresponding profile adapted to selectively engage the second key profile but not the first key profile, the second actuator tool further comprising an exterior seal for sealing against the piston in the second downhole valve thereby isolating the tubular string downhole of the second downhole valve when the second actuator tool is landed in the second downhole valve;

wherein the tubular string is positioned in a wellbore and cement isolates the wellbore between the first and second downhole valves.

2. The system of claim 1 wherein the exterior seal of the first actuator tool is uphole of the first corresponding profile of the first actuator tool.

3. The system of claim 2 wherein the exterior seal of the second actuator tool is uphole of the second corresponding profile of the second actuator tool.

4. The system of claim 1 wherein the cross sectional area of the one or more flow ports in each valve body is substantially equal to the cross-sectional area of the valve body.

5. The system of claim 1 wherein the pistons are initially shear pinned in the closed position.

6. The system of claim 1 further comprising a wiper dart adapted to remove cement from the first and second downhole valves during the displacement of cement through the tubular string and into the wellbore.

7. The system of claim 1 further comprising a retrieval tool adapted to being conveyed down the tubular string, connecting with the second actuator tool, and releasing the second actuator tool from engagement with the second key profile so that the second actuator tool can be retrieved from the tubular string.

8. A method for fracturing a well in a formation, the method comprising the steps of:

providing a system having at least two valves, each valve having a key profile disposed thereon, and a piston moveable between an open position and a closed position, wherein the key profile is disposed on the interior of the piston and wherein the key profile of each of the at least two valves is different from the key profile of the other of the at least two valves;

placing the system in a tubular string and cementing the string in a wellbore, the system located adjacent a production zone in the formation;

placing an actuator device into the tubular string, the actuator device having an actuator profile disposed thereon, wherein the actuator profile is selected to correspond with the key profile on only one of the at least two valves;

displacing the actuator device through the tubular string with a fluid until it reaches one of the at least two valves with the key profile that corresponds to the actuator profile and thereby engages the key profile disposed on the interior of the piston;

applying fluid pressure against the actuator device until the piston engaged by the actuator device moves from the closed position to the open position; and fracturing the cement and the formation adjacent the open valve.

9. The method of claim 8 wherein the actuator device further comprises an exterior seal uphole of the actuator profile, configured to seal against the piston when the actuator profile has engaged the corresponding key profile.

10. The method of claim 9 wherein the actuator device and seal isolate the tubular string downhole of the valve when the actuator profile has engaged the corresponding key profile.

11. The method of claim 8 further comprising the step of displacing a wiper dart through the tubular string to remove cement from the first and second valves while displacing the cement though the tubular string and into the wellbore.

12. The method of claim 8 wherein the step of applying fluid pressure to move the piston from the closed position to the open position further comprises shearing one or more shear pins holding the piston in the closed position.

13. The method of claim 8 further comprising conveying a retrieval tool down the tubular string, connecting the retrieval tool with the actuator device, releasing the second actuator tool from engagement with the second key profile, and retrieving the actuator device tool from the tubular string.

14. A profile selective system for actuating downhole tools in a tubular conduit comprising:

a first downhole tool, comprising a first key profile adapted to actuate the first downhole tool;

a second downhole tool spaced apart and uphole relative to the first downhole tool, comprising a second key profile adapted to actuate the second downhole tool;

a first actuator tool comprising a first corresponding profile adapted to selectively engage the first key profile but not the second key profile; and a second actuator tool comprising a second corresponding profile adapted to selectively engage the second key profile but not the first key profile;

wherein the tubular conduit is positioned in a wellbore and cement isolates the wellbore between the first and second downhole tools.

15. The profile selective system of claim 14 wherein:

when the first actuator tool is engaged with the first key profile, the first actuator tool prevents fluid flow through the tubular conduit when an uphole fluid pressure relative to the first actuator tool is greater than a downhole fluid pressure but allows fluid flow through the tubular conduit when the downhole fluid pressure is greater than the uphole fluid pressure; and when the second actuator tool is engaged with the second key profile, the second actuator tool prevents fluid flow through the tubular conduit when an uphole fluid pressure relative to the second actuator tool is greater than a downhole fluid pressure but allows fluid flow through the tubular conduit when the downhole fluid pressure is greater than the uphole fluid pressure.

16. The profile selective system of claim 15 wherein the first and second actuator tool each further comprise an actuator bore and a flow back bypass selectively sealing the actuator bore when the uphole fluid pressure is greater than the downhole fluid pressure.

17. The profile selective system of claim 14 wherein the first and second corresponding profiles are each biased radially outward toward the tubular conduit.

18. The profile selective system of claim 14 where the first and second corresponding profiles are each formed by a shoulder and at least two radial grooves and the first and second key profiles are formed by a shoulder and at least two raised radial rings.

19. The profile selective system of claim 14 further comprising:

a third downhole tool, comprising the first key profile adapted to actuate the third downhole tool; and a fourth downhole tool, comprising the second key profile adapted to actuate the fourth downhole tool.

20. The profile selective system of claim 19 wherein:

the first downhole tool is uphole of the third down hole tool and the first downhole tool further comprises a first profile release adapted to disengage the first corresponding profile from the first key profile in the first downhole tool after the first downhole too has been activated so as to allow the first actuator tool to move downhole of the first downhole tool; and the second downhole is uphole of the fourth down hole tool and the second downhole tool further comprises a second profile release adapted to disengage the second corresponding profile from the second key profile in the second downhole tool after the second downhole too has been activated so as to allow the second actuator tool to move downhole of the second downhole tool.

21. The profile selective system of claim 20 wherein each key profile is formed by a shoulder and at least two radial grooves and each sleeve profile is formed by a corresponding shoulder and at least two raised radial rings.

22. The profile selective system of claim 19 wherein:

when the first actuator tool is engaged with the first key profile, the first actuator tool prevents fluid flow through the tubular conduit when an uphole fluid pressure relative to the first actuator tool is greater than a downhole fluid pressure but allows fluid flow through the tubular conduit when the downhole fluid pressure is greater than the uphole fluid pressure; and when the second actuator tool is engaged with the second key profile, the second actuator tool prevents fluid flow through the tubular conduit when an uphole fluid pressure relative to the second actuator tool is greater than a downhole fluid pressure but allows fluid flow through the tubular conduit when the downhole fluid pressure is greater than the uphole fluid pressure.

* * * * *